US005729796A

United States Patent [19]

Miura et al.

[11] Patent Number: 5,729,796

[45] Date of Patent: Mar. 17, 1998

[54] SHUTTER HAVING FIRST AND SECOND SHUTTER MEMBERS, PROCESS CARTRIDGE AND IMAGE FORMING APPARATUS HAVING THE SHUTTER

[75] Inventors: Kouji Miura, Sagamihara; Tsutomu Nishiuwatoko, Tokyo; Kazuhiko Kanno, Urawa, all of Japan

[73] Assignee: Canon Kabushiki Kaisha, Tokyo, Japan

[21] Appl. No.: 789,061

[22] Filed: Jan. 28, 1997

Related U.S. Application Data

[63] Continuation of Ser. No. 429,099, Apr. 26, 1995, abandoned.

[30] Foreign Application Priority Data

Apr. 28, 1994 [JP] Japan ..... 6-091183
Apr. 21, 1995 [JP] Japan ..... 7-096886

[51] Int. Cl.[6] ..... G03G 21/18

[52] U.S. Cl. ..... 399/114

[58] Field of Search ..... 399/110, 111, 399/114

[56] References Cited

U.S. PATENT DOCUMENTS

| | | | |
|---|---|---|---|
| 4,470,689 | 9/1984 | Nomura et al. | 355/211 |
| 4,575,221 | 3/1986 | Onoda et al. | 355/200 |
| 4,588,280 | 5/1986 | Ogawa et al. | 355/200 |
| 5,061,959 | 10/1991 | Kinoshita et al. | 355/210 |
| 5,113,220 | 5/1992 | Kwak | 355/200 |
| 5,115,272 | 5/1992 | Ohmori et al. | 355/210 |
| 5,266,999 | 11/1993 | Yashiro | 355/211 |
| 5,331,373 | 7/1994 | Nomura et al. | 355/200 |
| 5,465,136 | 11/1995 | Watanabe | 355/210 |
| 5,486,898 | 1/1996 | Fujii et al. | 355/200 |

FOREIGN PATENT DOCUMENTS

| | | |
|---|---|---|
| 0467418 | 1/1992 | European Pat. Off. . |
| 61-219965 | 9/1986 | Japan . |
| 63-58365 | 3/1988 | Japan . |
| 63-129356 | 6/1988 | Japan . |
| 63-194271 | 8/1988 | Japan . |
| 6-19238 | 1/1994 | Japan . |

*Primary Examiner*—William J. Royer
*Attorney, Agent, or Firm*—Fitzpatrick, Cella, Harper & Scinto

[57] ABSTRACT

A shutter for a process cartridge including an electrophotographic photosensitive member, a processing device acting on the photosensitive member, a frame, an exposure opening for permitting exposure of the photosensitive member to image information light, an image transfer opening for permitting transfer of image from the photosensitive member to a recording material, the process cartridge that being detachably mountable to main assembly of an image forming apparatus, one shutter includes an engaging portion for engaging the shutter with the frame; a first shutter member for opening and closing the exposure opening; a second shutter member for opening and closing the transfer opening.

50 Claims, 22 Drawing Sheets

SHUTTER HAVING FIRST AND SECOND SHUTTER MEMBERS, PROCESS CARTRIDGE AND IMAGE FORMING APPARATUS HAVING THE SHUTTER

This application is a continuation of application Ser. No. 08/429,099, filed Apr. 26, 1995, now abandoned.

FIELD OF THE INVENTION AND RELATED ART

The present invention relates to a process cartridge, a shutter usable with the process cartridge and an image forming apparatus usable with the process cartridge.

Here, the image forming apparatus includes an electrophotographic copying machine, an electrophotographic printer (for example, LED printer, laser beam printer), an electrophotographic facsimile machine, an electrophotographic word processor, and the like.

The process cartridge means includes a cartridge having as a unit an electrophotographic photosensitive member, charging means, developing means and cleaning means, which is detachably mountable to a main assembly of an image forming apparatus. It may include as a unit an electrophotographic photosensitive member and at least one of charging means, developing means or cleaning means. It may include as a unit developing means and an electrophotographic photosensitive member.

An image forming apparatus using an electrophotographic process is known and is used with the process cartridge. This is advantageous in that the maintenance operation can be, in effect, carried out by the users thereof without expert service persons, and therefore, the operation can be remarkably improved. Therefore, this type is now widely used.

In such a process cartridge, the photosensitive member, for example, may deteriorate when it is exposed to light, or it may be damaged by physical contact with other parts, or the photosensitive member may be damaged. In order to avoid them, provision of a shutter member is known, for example, in U.S. Pat. Nos. 4,470,689 and 5,113,220.

The former discloses a process cartridge having a shutter for protecting an image transfer region of the photosensitive member, and the latter discloses a drum cartridge having two-part shutter member.

These are effective to protect the photosensitive member.

This invention is intended to provide a further improvement.

SUMMARY OF THE INVENTION

Accordingly, it is a principal object of the present invention to provide a shutter for protecting an electrophotographic photosensitive member, a process cartridge using the shutter, and an image forming apparatus usable with the process cartridge.

It is another object of the present invention to provide a shutter having an opening and closing mechanism which is simple in structure, a process cartridge using the shutter, and an image forming apparatus usable with the process cartridge.

It is another object of the present invention to provide a shutter constructed of a small number of parts and easy to assemble, a process cartridge using the shutter, and an image forming apparatus usable with the process cartridge.

It is a further object of the present invention to provide a shutter including a first shutter member and a second shutter member, which are integral, and a process cartridge using the shutter, and an image forming apparatus usable with the process cartridge.

It is a further object of the present invention to provide a shutter to make a shutter member openable and closable with a simple structure wherein a longitudinal dimension is small, a process cartridge using the shutter, and an image forming apparatus usable with the process cartridge.

It is a further object of the present invention to provide a shutter having a first shutter member and a second shutter member interrelated so that the mechanism is simplified, a process cartridge using the shutter, and an image forming apparatus usable with the process cartridge.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Figure 1:
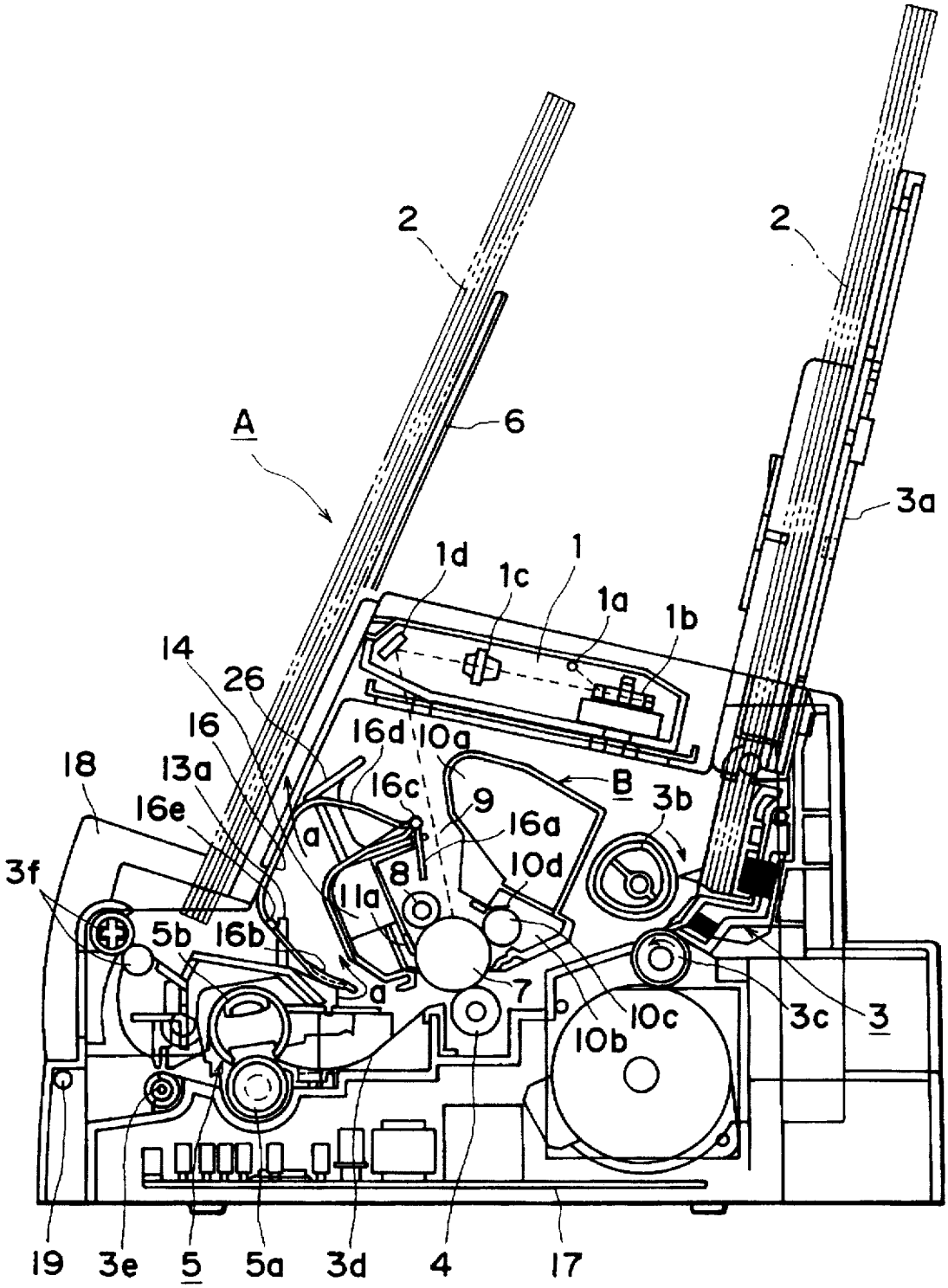
FIG. 1 is a sectional view of an image forming apparatus comprising a process cartridge.

The first embodiment will be described as a preferable embodiment, referring to FIGS. 1 to 16, and then, other embodiments will be described referring to FIGS. 18 to 20, and FIGS. 21 to 25.

Embodiment 1

The first embodiment will be described regarding: (1) General structures of the image forming apparatus and process cartridge; (2) Frame structure of the developing means; (3) Shutter structure; and (4) Structure for installing or removing the cartridge. Throughout the drawings, the same portions are identified by the same reference numerals.

{General Structure}

Figure 2:
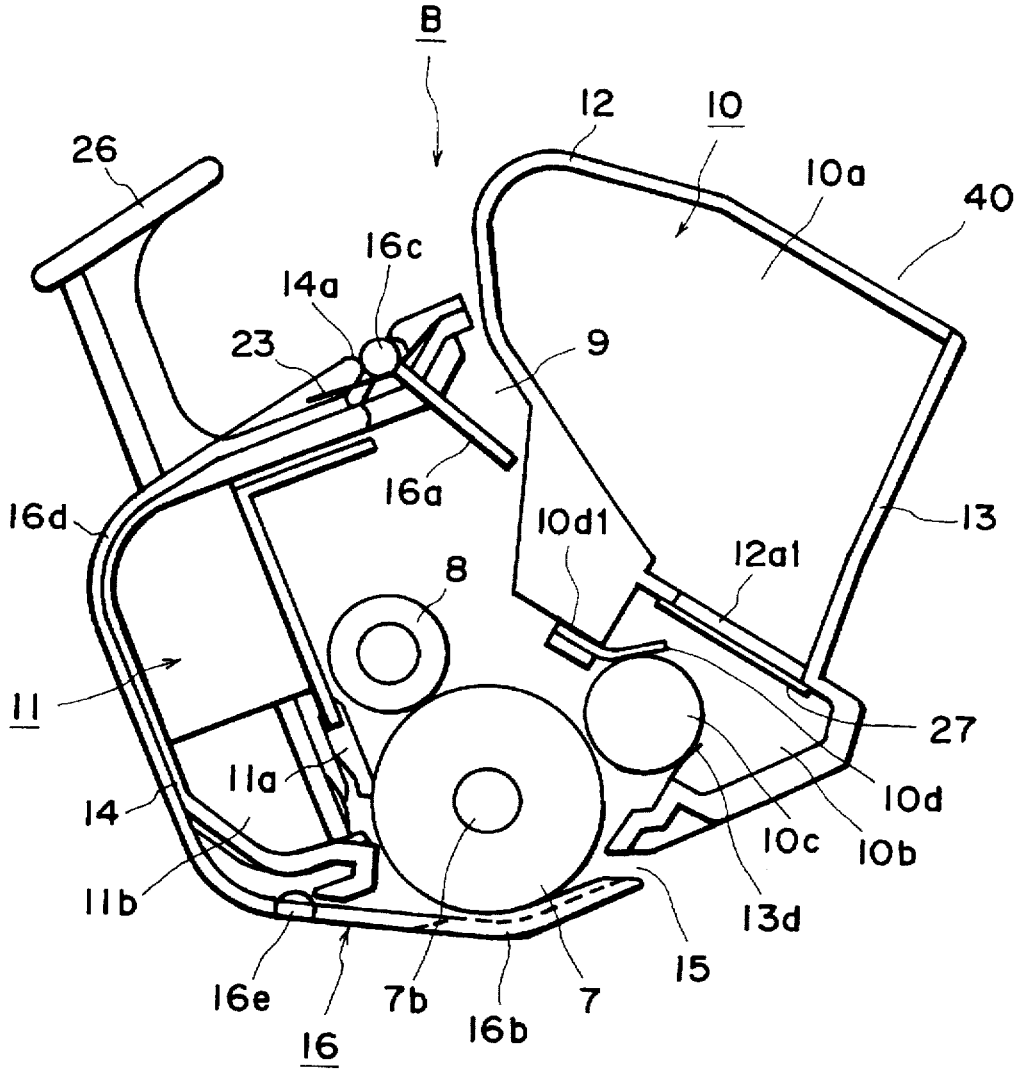
FIG. 2 is a sectional view of the process cartridge.
Figure 3:
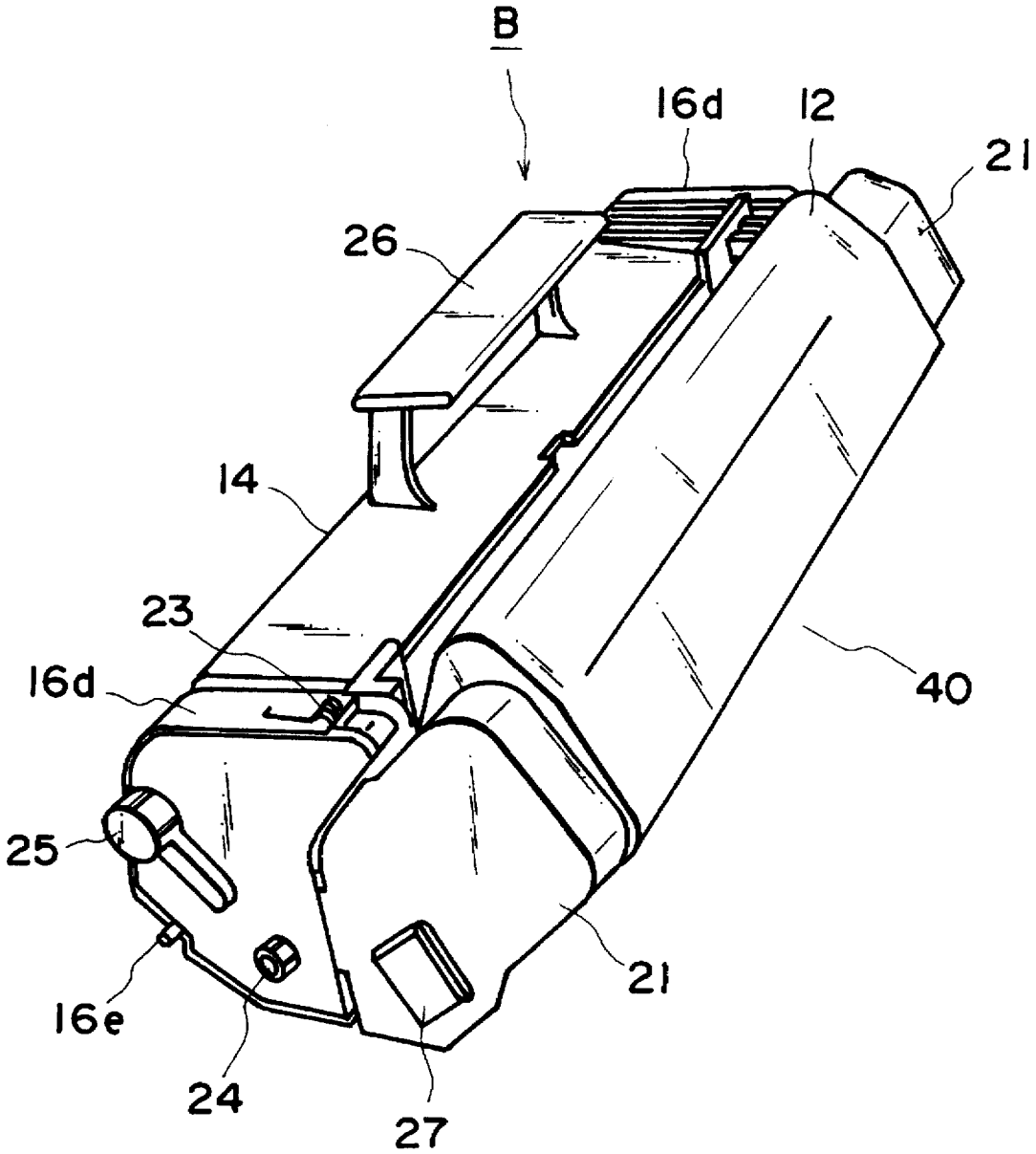
FIG. 3 is a perspective view of the process cartridge.
Figure 4:
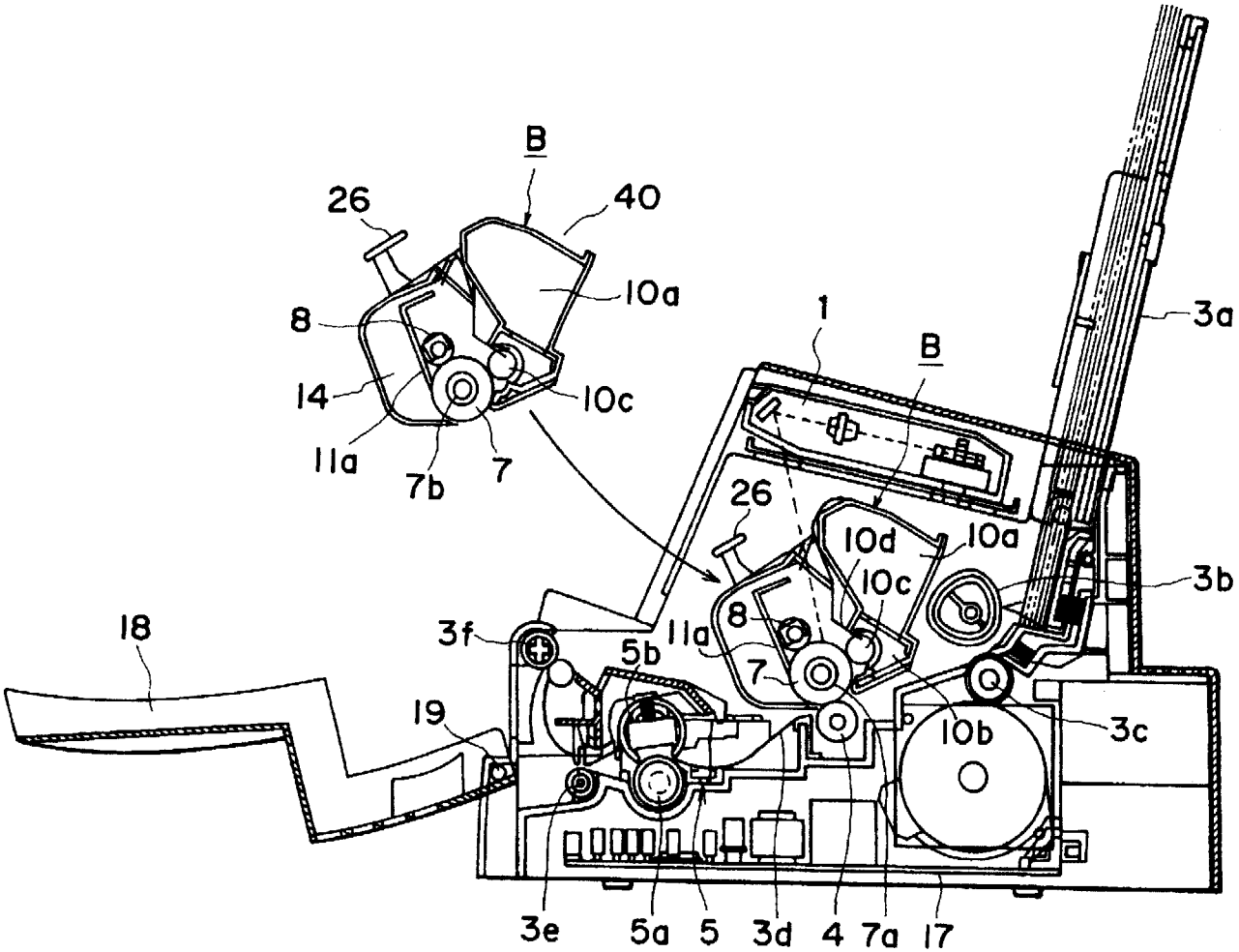
FIG. 4 is an explanatory drawing, which depicts how the cover of the image forming apparatus is opened and the process cartridge is installed in the apparatus.

The overall structures of the electrophotographic image forming apparatus and process cartridge will be described referring to FIGS. 1–4. FIG. 1 is a sectional view of the electrophotographic image forming apparatus in which the process cartridge has been installed, and depicts its overall structure. FIGS. 2 and 3 are sectional and perspective views of the process cartridge, respectively, and depict the corresponding structures. FIG. 4 is an explanatory drawing, which depicts how the cover of the image forming apparatus is opened and the cartridge is installed into the main assembly of the image forming apparatus.

Referring to FIG. 1, this electrophotographic image forming apparatus A is of a type which forms an image on recording medium through the electrophotographic image forming process. First, a toner image is formed on a drum-shaped electrophotographically sensitive member 7 (hereinafter, photosensitive drum) as an image bearing member. Meanwhile, a sheet of recording medium 2 placed in a feeder tray 3*a* is conveyed by a conveying means 3 comprising a pickup roller 3*b*, conveying roller 3*c*, conveying path 3*d*, and the like, in synchronism with the toner image formation. Next, a voltage is applied to a transfer roller 4 as transferring means, whereby the toner image formed on the photosensitive drum 7, which a process cartridge B comprises, is transferred onto the recording medium 2. Then, the recording medium having received the toner image is delivered to a fixing means 5. This fixing means 5 comprises a driving roller 5*a* and a fixing roller 5*b* containing a heater, and applies heat and pressure to the recording medium 2 which is passed through the fixing means 5, whereby the transferred toner image is fixed. Next, the recording medium 2 bearing now the fixed toner image is conveyed, being flipped over while being conveyed, by discharging rollers 3*e* and 3*f* into a discharge tray 6.

In the process cartridge B, the surface of a photosensitive drum 7 as the image bearing member with a photosensitive layer is uniformly charged by applying a voltage to a charging roller 8, which is a charging means, while the photosensitive drum 7, having base member 7*b*, is rotated. Next, a laser beam carrying the image data is projected by an optical system 1 onto the photosensitive drum 7 through an exposure opening 9, whereby a latent image is formed on the photosensitive drum 7. This latent image is developed with toner by a developing means 10.

The charging roller 8 is placed in contact with the photosensitive drum 7 to charge the photosensitive drum 7. The developing means 10 develops the latent image formed on the photosensitive drum 7 by supplying the toner to the photosensitive drum 7 on the regions to be developed. The optical system 1 comprises a laser diode 1*a*, a polygon mirror 1*b*, a lens 1*c*, and a full-reflection mirror 1*d*.

In this developing means 10, the toner within a toner chamber 10*a* is supplied to a developing chamber 10*b*, and as a developing roller 10*c* mounted within the developing chamber 10*b* is rotated, a layer of toner charged triboelectrically by a developing blade 10*d* is formed on the surface of the developing roller, in which a magnet is fixed. The toner is supplied from this toner layer to the photosensitive drum 7, on the region to be developed. As the toner is transferred onto the photosensitive drum 7 in correspondence with the latent image, the latent image is visualized. In other words, a toner image is formed on the photosensitive drum 7.

A voltage with a polarity opposite to that of the toner image is applied to the transfer roller 4, whereby the toner image on the photosensitive drum 7 is transferred onto the recording medium 2. Then, the residual toner on the photosensitive drum 7 is removed by a cleaning means 11. The cleaning means 11 comprises an elastic cleaning blade 11*a*, and the toner remaining on the photosensitive drum 7 is scraped off by the elastic cleaning blade 11*a* to be collected in a waste toner collector 11*b*.

Various components such as the photosensitive drum 7 are integrated into a cartridge, which is realized by disposing them within a cartridge frame formed by combining a developing means frame member 12, a developing means wall member 13, and a cleaning means frame member 14. More specifically, the developing means frame member 12 and developing means wall member 13 are welded together to form the toner chamber 10*a* and developing chamber 10*b*, and the developing roller 10*c* and developing blade 10*d* are mounted within this developing chamber 10*b*. On the cleaning means frame member 14, the photosensitive drum 7, charging roller 8, and various components constituting the cleaning means 11 are mounted. Finally, the process cartridge B is formed by pivotably combining the developing means frame member 12 and cleaning means frame member 14.

The process cartridge B is provided with an exposure opening 9, which allows the light beam carrying the image data to be irradiated onto the photosensitive drum 7, and a transfer opening 15, which allows the photosensitive drum 7 to face directly the recording medium 2 so that the toner image on the photosensitive drum 7 can be transferred onto the recording medium 2. Also, the process cartridge B comprises a shutter member 16, which exposes or covers the openings 9 and 15.

Referring to FIG. 4, the image forming apparatus A comprises a cover 18, which is mounted on the apparatus main assembly 17 in such a manner as to be rotatable about an axis 19. As the rotatable cover 18 is opened, a guiding member 20 (refer to FIG. 13) for guiding the process cartridge B into the apparatus main assembly is exposed. An operator installs the process cartridge B, or removes it, along this guiding member 20.

{Structure of Developing Means Frame}

Figure 5:
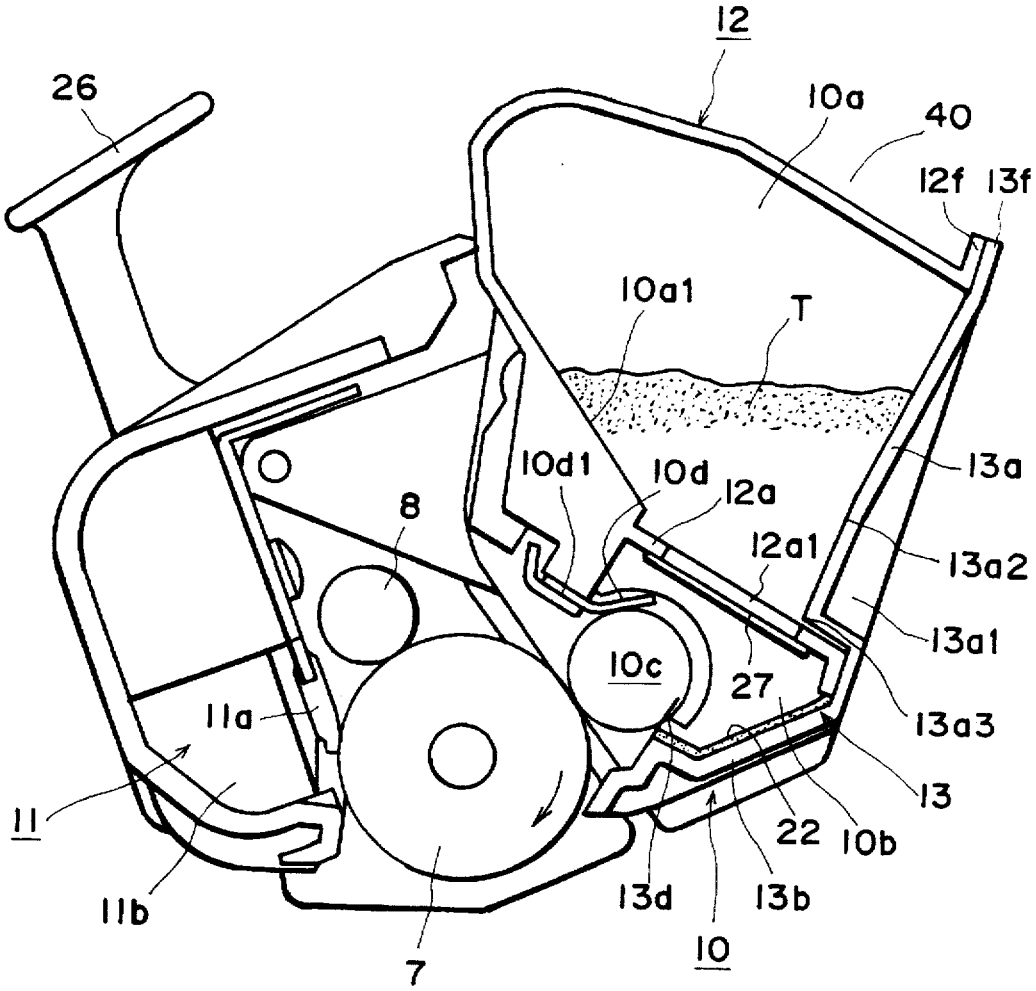
FIG. 5 is a sectional view of a developing means.
Figure 6:
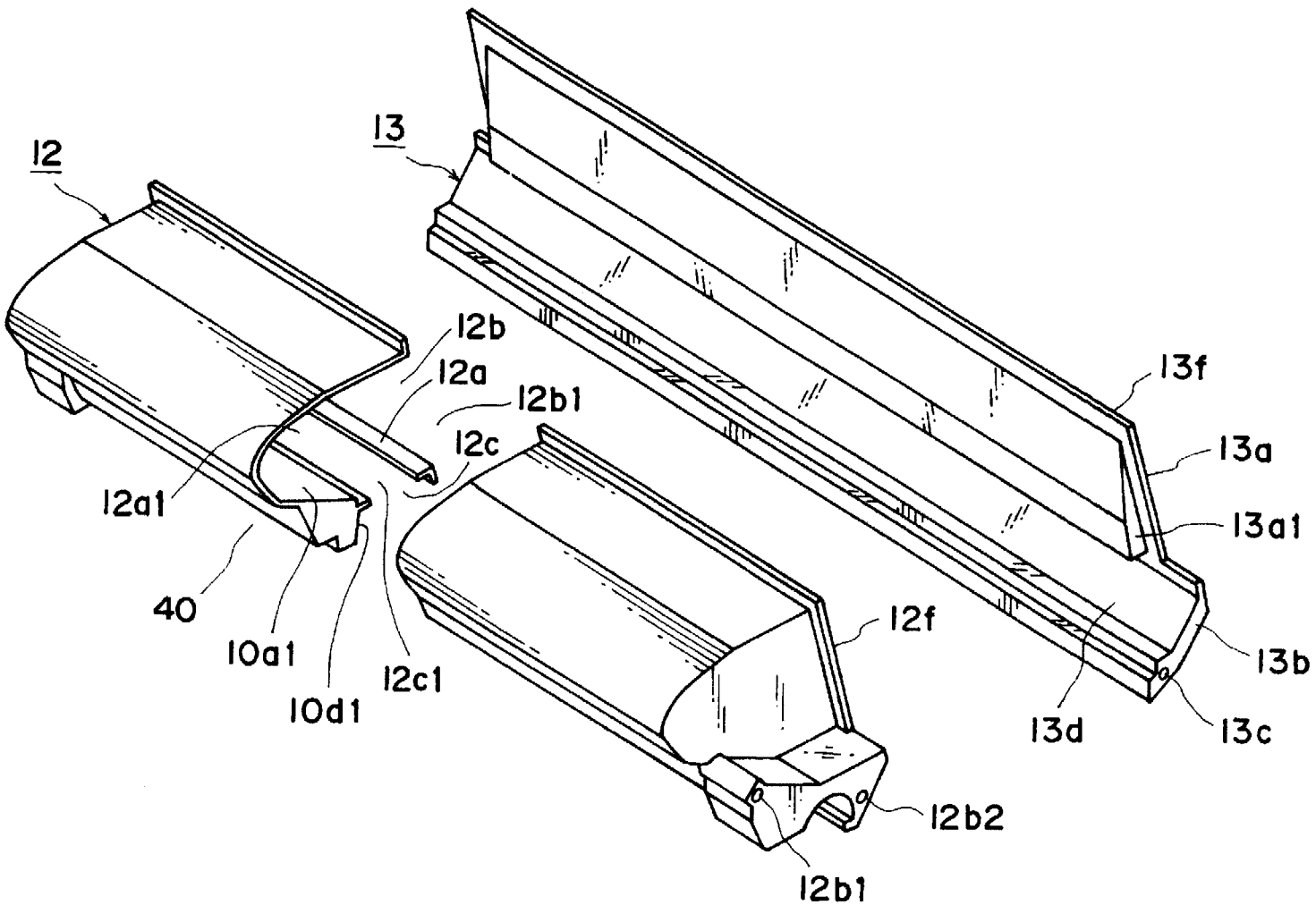
FIG. 6 is a perspective view illustrating separately the frame and wall members of the developing means.
Figure 7:
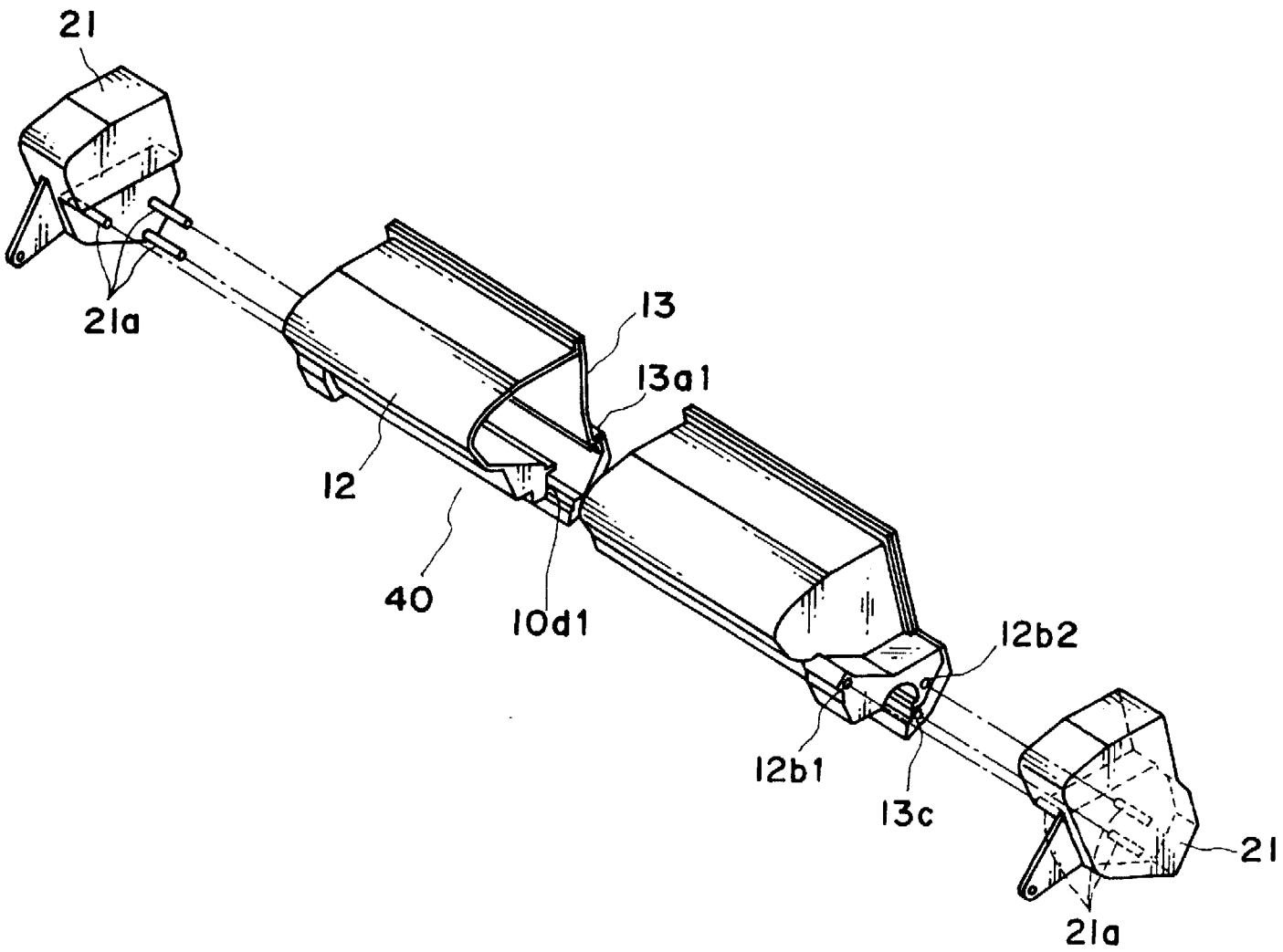
FIG. 7 is a perspective view illustrating how the developing means frame and the developing means wall are attached.

Next, referring to FIGS. 5–7, the structure of the frame constituting a portion of the developing means will be described. FIG. 5 is a sectional view of the developing means. FIG. 6 is a perspective view illustrating separately the developing means frame and developing means wall. FIG. 7 is a perspective view describing how the developing means frame and developing means wall are combined.

Referring to FIGS. 5 and 6, the developing means 10 comprises the toner chamber 10*a* and developing chamber 10*b*, which are formed by combining the developing means frame member 12 and developing means wall member 13.

The developing means frame member 12 constitutes the main structures of the toner chamber 10*a* and developing chamber 10*b*, and comprises a toner chamber portion 12*b*, which is the portion above a seal mounting portion 12*a* provided with a toner supplying opening 12*a*1 and constitutes a portion of the toner chamber 10*a*, and the developing chamber portion 12*c*, which is the portion below the seal mounting portion 12*a* and constitutes a portion of the developing chamber 10*b*. The walls of the toner chamber section 12*b* and developing chamber portion 12*c* are opened 12*a*1 (12*c*1), wherein the toner chamber section 12*b* is formed so its opening side to tapers out, and is provided with a toner filling opening (unillustrated) disposed on one of the longitudinal ends.

The developing means wall member 13 is combined with the developing means frame member 12 in such a manner as to cover the open side of the developing means frame member 12. It integrally comprises a toner chamber wall portion 13*a*, which is to cover the opening of the toner chamber 10*a* of the developing means frame member 12, and a developing chamber wall portion 13*b*, which is to cover the opening of the developing chamber 10*b*. A recessed portion 13*a*1, which causes the toner chamber wall portion 13*a* to recess from the developing chamber wall portion 13*b*, is provided at the border line between the toner chamber wall portion 13*a* and developing chamber wall portion 13*b*.

The developing means frame member 12 and developing means wall member 13 are formed of resin by injection molding.

The aforementioned components are assembled in the following manner. First, the wall member 13 is placed in a manner to cover the opening of the frame member 12, and the joints between them are welded. In this embodiment, when the frame member 12 and wall member 13 are joined, an end member 21 is attached at each of the longitudinal ends of the frame and wall members 12 and 13, as shown in FIG. 7, so that both members 12 and 13 are accurately fixed to each other.

In order to accomplish this placement, boss holes 12*b*1 and 12*b*2 are provided on each of the longitudinal end surfaces of the frame member 12, and also, boss holes 13*c* are provided on the each of the longitudinal end surfaces of the wall member 13. The end member 21 is provided with bosses 21*a* as positioning means which are fitted into the boss holes 12*b*1, 12*b*2, and 13*c*.

When the frame member 12 and wall member 13 are thus combined, the joint between the frame member 12 and toner chamber wall portion 13*a* is melt-welded, but the joint between the frame member 12 and developing chamber wall portion 13*b* is pressure-welded with the interposition of a toner leak preventing seal 22 (refer to FIG. 5) composed of foamed polyurethane. Since the joint where the seal 22 is interposed is not melt-welded, the joint is not as strong as the melt-welded joint. However, since the bosses 21*a* of the end member 21 are fitted into the correspondent boss holes 12*b*1, 12*b*2, and 13*c*, the positional relation between the frame and wall members 12 and 13 can be just as firm and reliable as in the case of the melt-welding, and further, even when a torsional force or the like is applied on the joint, no gap is liable to be generated at the joint; in other words, no toner is liable to leak from the joint.

Further, the end member fixes the positional relation between the frame member 12 and the developing roller 10*c* when the latter is mounted on the former, and also, functions as a positioning member when the cleaning means frame 14 is connected to the frame member 12, to which the wall member 13 has been welded.

When the frame member 12 and wall member 13 are joined as described above, the bottom end portion of the toner chamber wall portion 13*a* is disposed substantially level with the longitudinal edge of the toner supplying opening 12*a*1 (refer to FIG. 5) since the recessed portion 13*a*1 is provided on the wall member 13. The opening 12*a*1 is sealed by attaching a sealing member 27 to the toner supplying opening 12*a*1 by gluing, welding, or the like means, and the developing roller 10*c* and developing blade 10*d* are mounted in the developing chamber 10*a*. After the developing means 10 is assembled in this manner, toner T is filled into the toner chamber 10*a* through the aforementioned toner filling opening, and the toner filling opening is sealed with a cap (unillustrated), completing the production of the developing means 10.

Next, the cleaning means frame, to which the photosensitive drum 7, cleaning means 11, and the like have been mounted, is connected to the integrated frame and wall members 12 and 13, finishing assembling the process cartridge B.

Referring to FIG. 5, the frame member 12 is formed so the toner chamber 10*a* is above the developing chamber 10*b*, and for a portion of the toner chamber 10*a* to project toward the photosensitive drum 7 slightly beyond the developing chamber 10*b*.

In this embodiment, the first frame (frame member 12) comprises: a toner storing portion (toner chamber portion 12*b*) for storing the toner to be used for development; an opening portion 12*b*1 of the toner storing section; and a toner supplying opening 12*a*1, which allows the toner stored in the toner storing portion to be supplied to the developing station. The second frame member (wall member 13) comprises: a developing means mounting portion 13*d* where the developing roller 10*c* as the developing means is mounted; and a cover portion (toner chamber wall portion 13*a*), which closes up the opening portion 12*b*1 of the toner storing section. The first and second frames are joined to form a developing means frame. In other words, the developing means frame of this embodiment comprises: the first frame (frame member 12), which includes a toner storing portion, and a developing portion (a portion where the developing means mounting portion 13*d* is provided) for developing the latent image formed on the photosensitive drum 7, with the toner stored in the toner storing section, and extends from the toner storing section to the developing section (region directly facing the developing station; and the second frame (wall member 13), which extends from the developing section to the toner storing section (region correspondent to the toner storing section).

The first frame is provided with a developing blade mounting portion where a developing blade 10*d*1 for regulating the amount of the toner, which adheres to the circumference of the developing roller 10*c* mounted on the developing means mounting section 13*d* of the second frame, is mounted. The wall portion 10*a*1 of the toner storing portion of the first frame is slanted toward the toner supplying opening 12*a*1 so that the toner within the toner storing section is supplied to the developing region without waste. The sealing member 27 for sealing the toner supplying opening 12*a*1 is removably attached to the toner supplying opening 12*a*1. Therefore, the toner within the toner storing section is prevented from leaking out before the process cartridge B is put to use. This sealing member 27 is to be removed by the operator before the process cartridge is used.

The cover portion of the second frame member (toner chamber wall portion 13*a*) is provided with a slanted surface 13*a*2, which is slanted toward the toner supplying opening 12*a*1 when the first and second frames are joined. The location of the bottom end portion 13*a*3 of the this slanted surface 13*a*2 substantially coincides with the location of the edge portion of the toner supplying opening 12*a*1. Therefore, the toner within the toner storing section can be supplied to the developing region without being wasted.

When the first and second frames are joined, they are joined on the side where the toner storing portion is formed, that is, by the sides 12*f* and 13*f*, respectively. They may be joined by melt-welding (for example, ultrasonic welding), gluing, small screws and nuts, spring clips, or the like. Further, an end member 21 is provided for joining the first and second frames, and it is fitted at each of the longitudinal ends of the first and second frames. The end member 21 is provided with boss holes, into which bosses 21*a* provided as the positioning means on the first and second frame, on each of the longitudinal end surfaces, are fitted to fix the positional relation between the first and second frames. Further, when the first and second frames are joined, an elastic sealing member (toner leak preventing seal 22) is interposed on the side where the developing means mounting portion 13*d* is provided.

Both of the first and second frames are integrally formed of plastic material (for example, highly impact resistant styrene).

Therefore, the internal volume of the toner chamber 10*a* can be increased to store more toner without increasing the size of the process cartridge B. In addition, since the toner chamber portion 10*a* of the frame member 12 is formed so as for its open side to taper out, it can be formed of resin material or the like by injection molding.

As the sealing member 27 is peeled off when the process cartridge B begins to be used, the toner within the toner chamber 10*a* is supplied from the toner chamber 10*a* to the developing chamber 10*b* due to its own weight; therefore, it is unnecessary to provide a dedicated toner sending member. Further, when the process cartridge B is in the image forming apparatus A (in the state illustrated in FIG. 5), the seal mounting portion 12*a* slopes down towards the right, and the toner chamber wall portion 13*a* is placed substantially level with the right-hand edge portion of the toner supplying opening 12*a*1 due to the provision of the recessed portion 13*a*1 on the wall member 13; therefore, the toner does not remain on the back side of the seal mounting portion 12*a*.

It is preferable that the joint between the frame and wall members 12 and 13 is melt-welded as described before so that the joint is reliably sealed to prevent toner leakage or the like. However, they may be joined by means different from the melt-welding; they may be joined with small screws and nuts, hooks, with the interposition of sealing material such as foamed polyurethane or the like in the joint portion, or may be joined by gluing or the like.

{Structure of Shutter}

Figure 8:
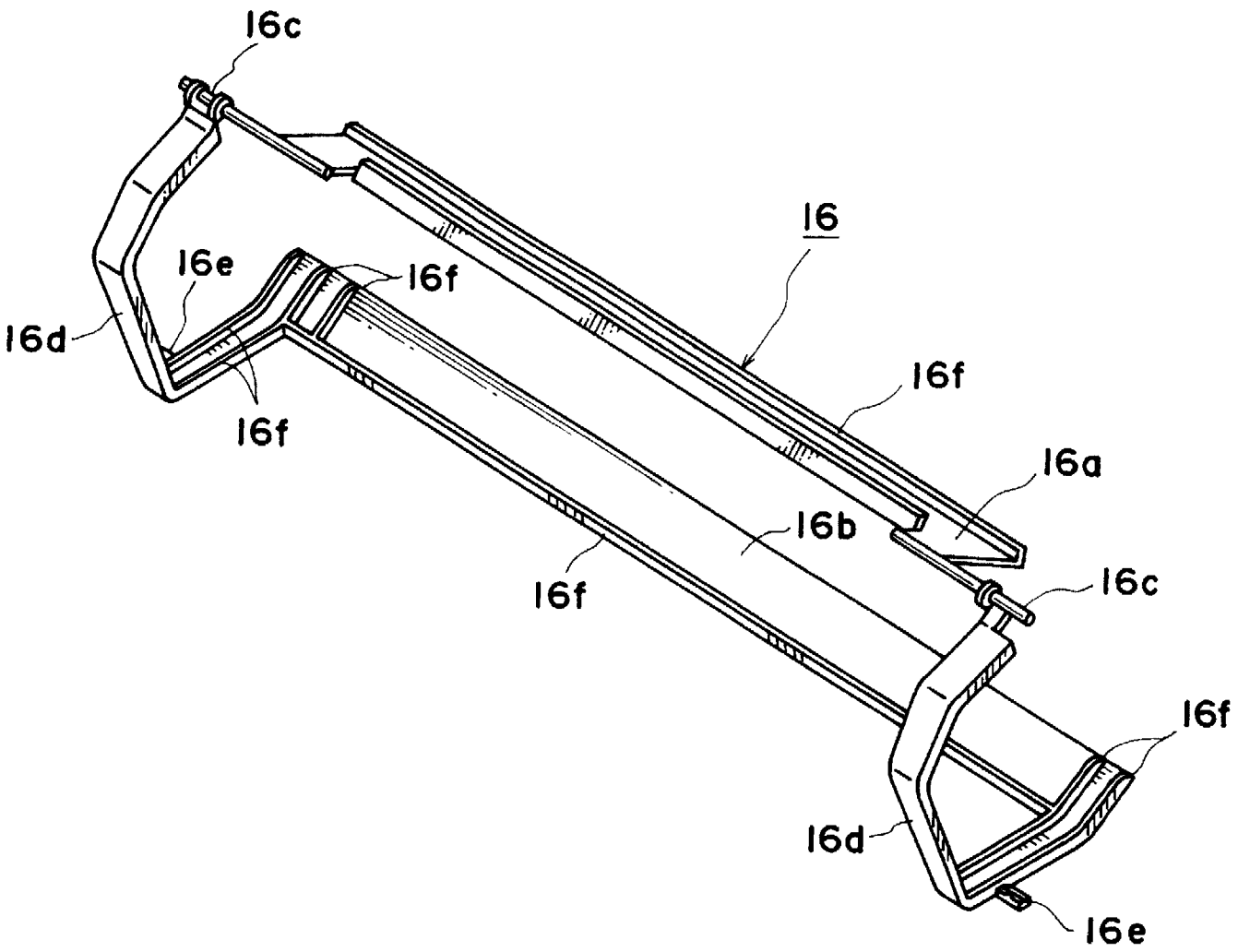
FIG. 8 is a perspective view of a shutter member.
Figure 9A:
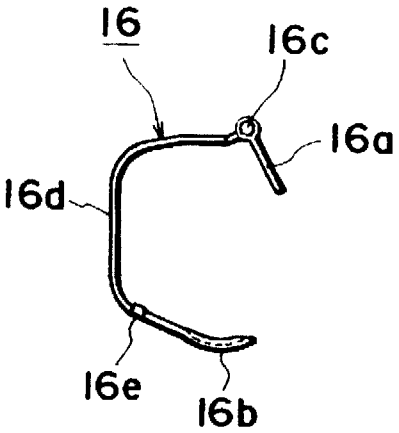
FIG. 9(*a*) is a plan view of the shutter member, and FIG. 9(*b*) is a side view of the shutter member, as seen from the longitudinal direction.
Figure 9B:
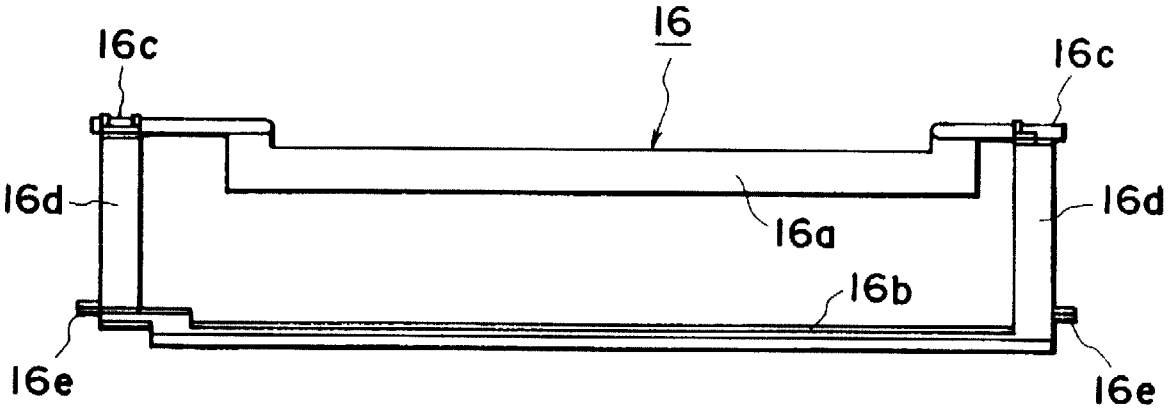
Figure 10:
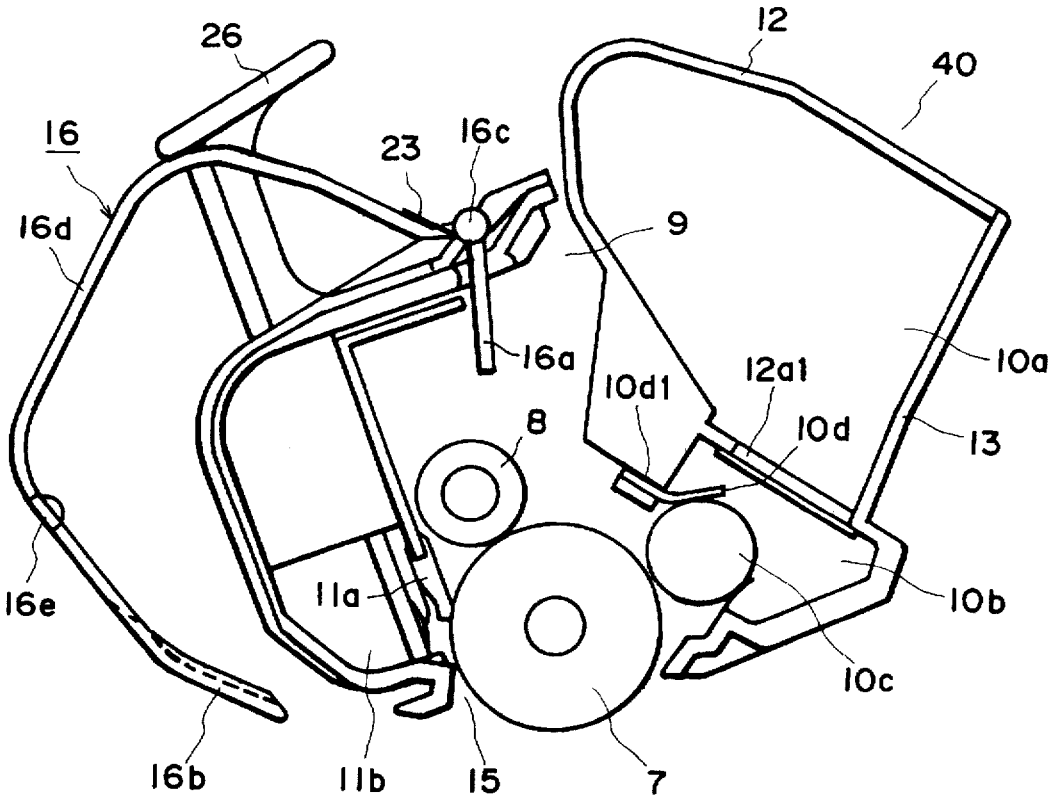
FIG. 10 is a sectional view of the shutter member, which is open.
Figure 11:
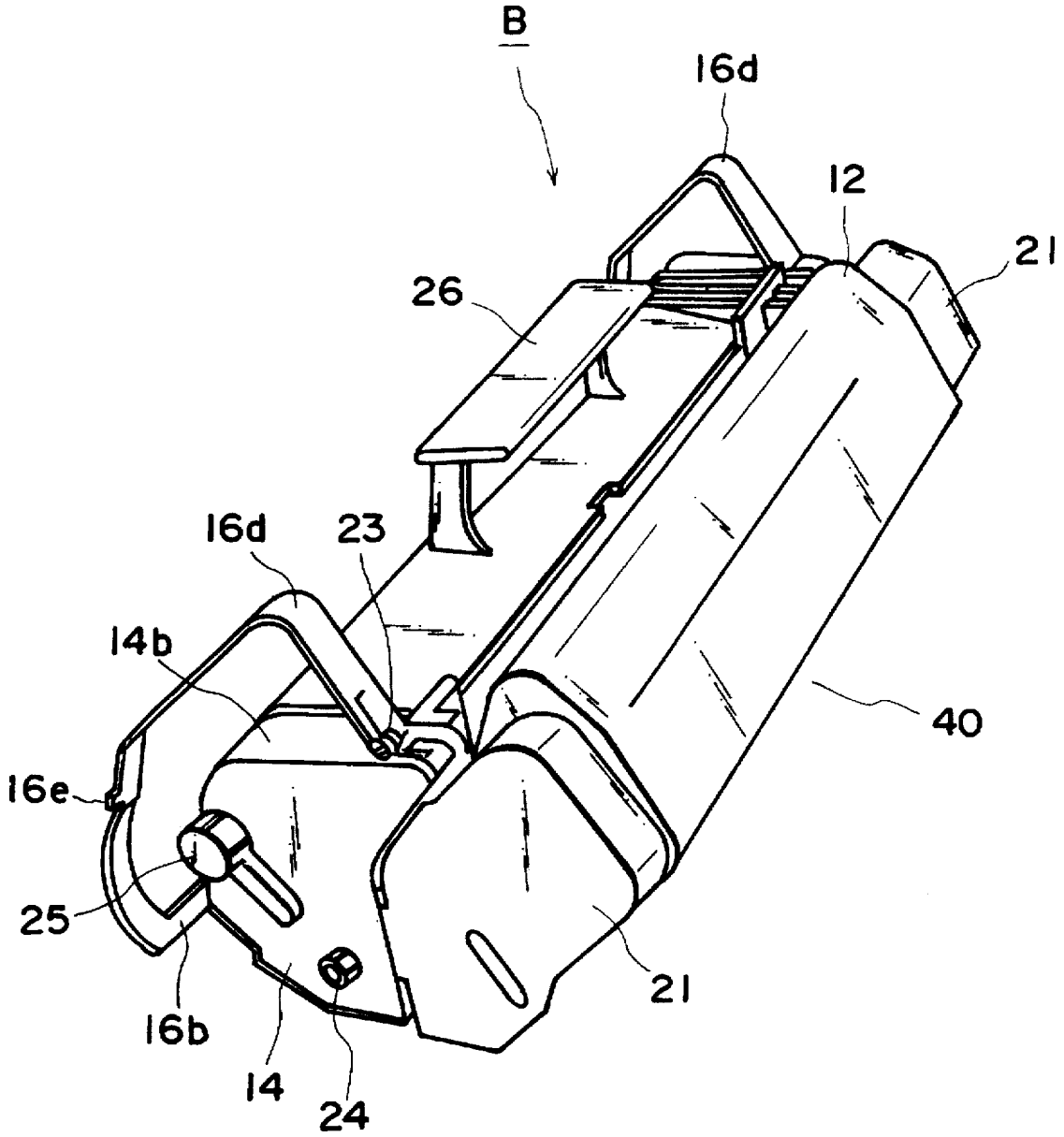
FIG. 11 is a perspective view of the shutter member, which is open.

Next, the shutter structure will be described referring to FIGS. 8–11. FIG. 8 is a perspective view of the shutter member. FIG. 9(*a*) is a plan view of the shutter member as seen from the crosswise direction; FIG. 9(*b*) is a side view of the shutter member as seen from the longitudinal direction. FIG. 10 is a sectional view of the open shutter member. FIG. 11 is a perspective view of the open shutter member.

At the upper portion of the frame of the aforementioned process cartridge B, an exposure opening 9 is provided, and at the bottom portion, a transfer opening 15 for transferring the toner image formed on the photosensitive drum 7 onto the recording medium 2 is provided. These openings 9 and 15 are exposed or covered by the shutter member 16. In the embodiment, which will be described below, both of the openings 9 and 15 are formed by cooperation of the developing means frame member 12 and cleaning means frame member 14.

Referring to FIGS. 8 and 9, the shutter member 16 integrally comprises the first shutter portion 16*a*, which exposes or covers the exposure opening 9, and the second shutter portion 16*b*, which exposes or covers the transfer opening 15. The damage to the surface of the photosensitive drum 7, adhesion of foreign matter such as dust to the photosensitive drum 7, optical aging of the photosensitive material, and the like, can be prevented by these shutter portions 16*a* and 16*b*.

Referring to FIGS. 9(*a*) and 9(*b*), this shutter member 16 comprises a rotational axis 16*c*, which is provided at each of the longitudinal ends. The first shutter portion 16*a* diagonally extends from the axis 16*c* in the inclined downward direction, and the second shutter portion 16*b* is disposed in such a manner as to bridge two arm portions 16*d*, which extend from the corresponding axes 16*c* in the direction opposite to the shutter portion 16*a*, and then, curve downward and to the right following the contour of the cleaning means frame 14.

Referring to FIG. 2, a bearing section 14*a* with a U-shaped cross-section is provided on the cleaning means frame 14, on the upper portion at each of the longitudinal ends. The rotational axis 16*c* of the shutter member 16 is fitted into this bearing section 14*a*; in other words, the shutter member 16 is mounted so as to be rotatable around the third frame 14. A torsional coil spring 23 is attached to one of the rotational axes 16*c*, which provides a force to pressure constantly the shutter member 16 in the direction of closing the openings 9 and 15.

The U-shaped groove of the bearing section 14*a* is formed in an elastically deformable manner, with its opening being narrower than the groove itself; therefore, the second shutter portion 16*b* can be simply attached just by snapping in the axis 16*c* from above by force. In other words, the axis 16*c* is retained in the U-shaped bearing section 14*a* by the elasticity of the bearing section, and it can be easily pulled out of the bearing section 14*a*.

An engagement projection 16*e* is provided at a predetermined location of the aforementioned arm portion 16*d*. As the process cartridge B is inserted into the image forming apparatus A as will be described later, the engagement projection 16*e* engages with the engagement portion 13*a* of the main assembly of the apparatus A, whereby the shutter member 16 is rotated about the axis 16*c*. As a result, the first shutter portion 16*a* exposes the exposure opening 9, and at the same time, the second shutter portion 16*b* exposes the transfer opening 15.

More specifically, the projection 16*e* is provided on the lateral end of the arm portion 16*d*, which is one of the arm portions. As the process cartridge B is installed into the main assembly of the apparatus A, the projection 16e comes in contact with the engagement portion 13a provided on the main assembly of the apparatus A, and engages with it, being thereby subjected to a force which works in the direction of opening the shutter member 16. It should be noted here that the projection 16e projects outward in the axial direction of the photosensitive drum.

The first shutter portion 16a, which exposes or covers the exposure opening 9, and the second shutter portion 16b, which exposes or covers the transfer opening 15, are integrally formed as described above. Therefore, it is unnecessary to employ a complicated link mechanism, which not only allows the reduction in the component count of the shutter member 16, but also simplifies the assembly process of the shutter member 16. Further, the shutter member can be more reliably opened or closed.

Referring to FIG. 11, the arm portion 16d is made of thin plate material, and is formed to follow the external contour of the cleaning means frame 14. At the longitudinal lateral end portion of the cleaning means frame 14, a recessed portion 14b is formed, the depth of which matches the thickness of the arm portion 16d. Therefore, when the shutter member is in the closed state, the arm portion 16d is fitted in the recessed portion 14b, with the external surface of the arm portion being substantially level with the external surface of the cleaning means frame 14.

With the above described arrangement, the arm portion 16d does not project from the cartridge frame in the longitudinal direction, nor above the external surface of the cleaning means frame. Therefore, not only can the cartridge B size be reduced in the longitudinal direction, but also, its overall size can be reduced.

Referring to FIG. 1, as the process cartridge B of this embodiment is installed into the image forming apparatus A, the shutter member 16 is rotated, whereby the second shutter portion 16b is moved to a position above the fixing means 5. This fixing means 5, which contains a heater, generates heat, but an air passage is created between the second shutter portion 16b and cleaning means frame 14, allowing thereby the air heated by the fixing means 5 to flow upward; therefore, the heat generated by the fixing means 5 can be easily discharged to prevent an internal temperature increase of the apparatus.

Further, the shutter member 16 comprises reinforcing ribs 16f, which are provided on the edge of the arm portion 16d, and edges, or their adjacencies, of the shutter portions 16a and 16b.

As described above, the shutter member 16 of this embodiment comprises the first and second shutter portions 16a and 16b, and axis 16c, which are integrally formed. The axis 16c is the rotational center, about which the shutter member 16 attached to the cleaning means frame 14 rotates, and also, is the engagement portion, with which the shutter member 16 is attached to the cleaning means frame 14. The second shutter portion 16b is connected to the axis 16c with the arm portion 16d, wherein the configuration of the arm portion 16d is such that it matches the contour of the external wall surface of the process cartridge B when the shutter member 16 is mounted on the cleaning means frame 14. The arm portion 16d is located at each of the longitudinal ends of the second shutter portion 16b. The shutter member 16 is a single piece component of plastic material (for example, highly impact resistant styrene or the like). In other words, the first and second shutter portions 16a and 16b, axis 16c, arm portion 16d, projection 16e, and ribs 16f are integrally formed of plastic material.

{Structure for Installing or Removing Cartridge}

Figure 12:
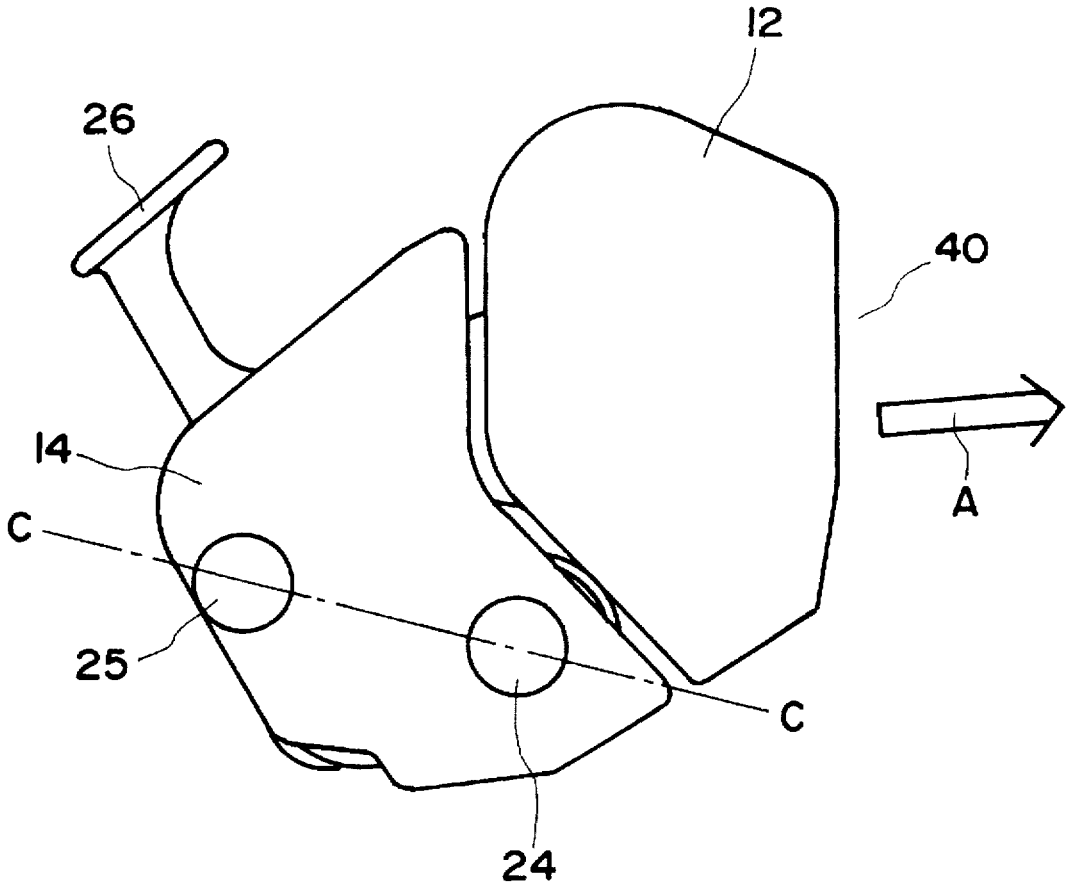
FIG. 12 is a side view of the process cartridge.
Figure 13:
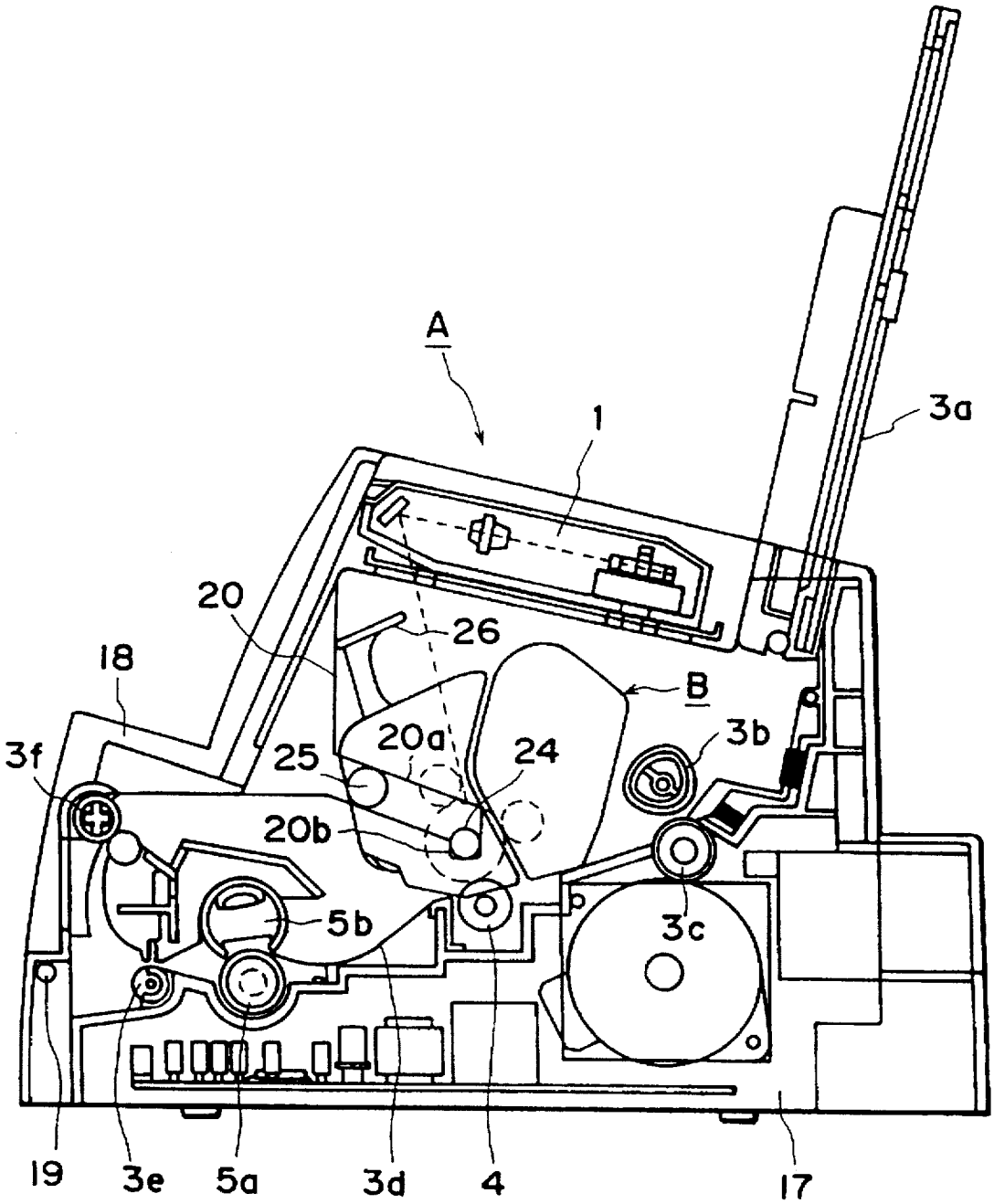
FIG. 13 is a sectional view of a portion that serves as a guide during the cartridge installation.
Figure 14:
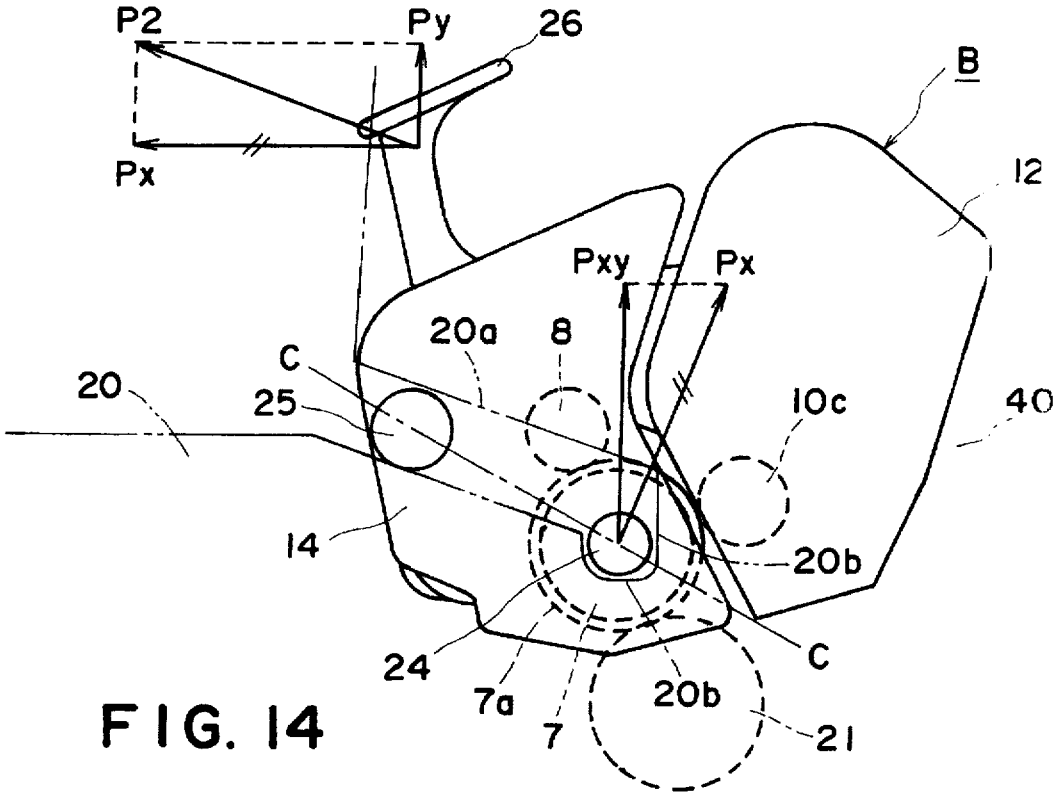
FIG. 14 is an explanatory drawing, which depicts how the process cartridge is removed from the image forming apparatus, wherein the first projection is in engagement with a recessed portion.
Figure 15:
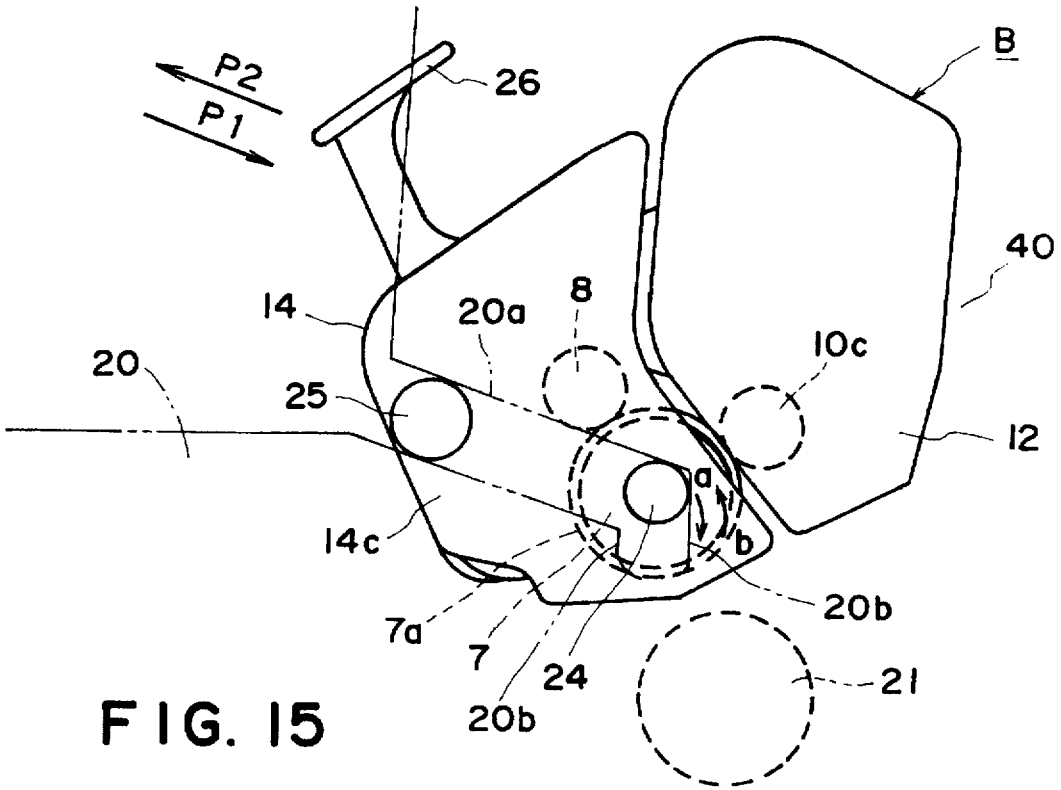
FIG. 15 is an explanatory drawing, which depicts how the process cartridge is removed, wherein the process cartridge has been rotated about the second projection by pulling a knob.
Figure 16:
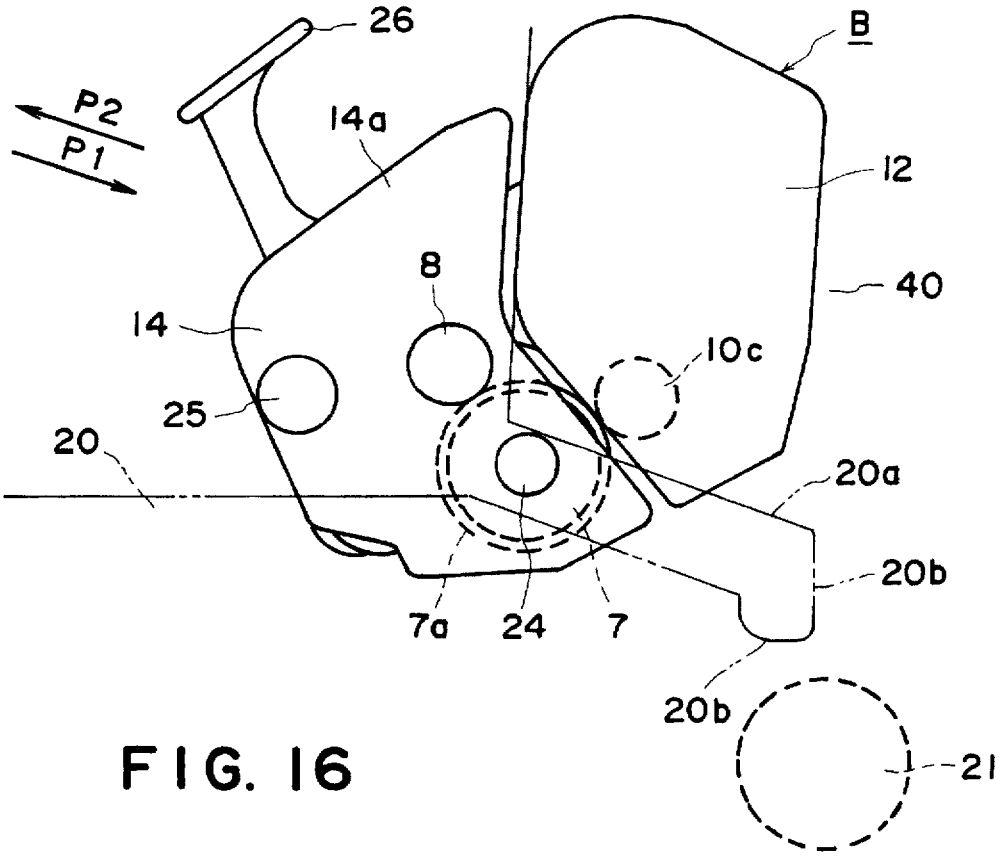
FIG. 16 is an explanatory drawing, which depicts how the process cartridge is removed, wherein the process cartridge is being pulled out by pulling the knob.
Figure 17:
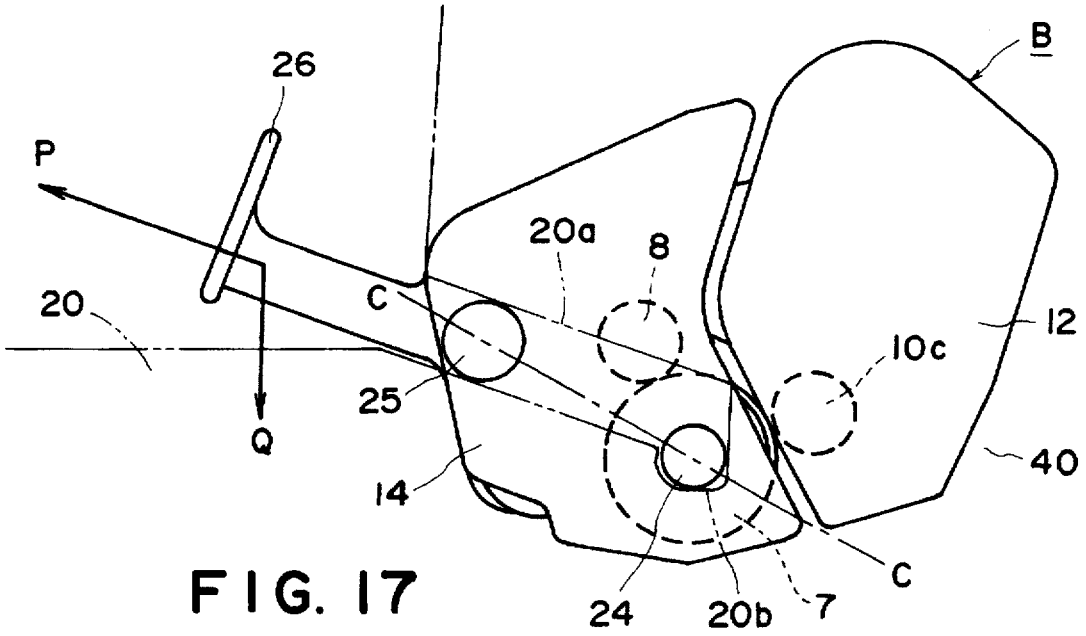
FIG. 17 is a sectional view of a different type of process cartridge, the knob of which is not provided on the top.

Referring to FIG. 4 and FIGS. 12–17, the structure for installing the process cartridge B into the image forming apparatus A, or removing it therefrom, will be described. FIG. 12 is a side view of the process cartridge. FIG. 13 is a sectional view of a cartridge installation guide. FIGS. 14–16 are explanatory drawings for depicting how the cartridge B is taken out. FIG. 17 is an explanatory drawing for depicting how the cartridge B, which has a knob disposed at a position other than on the top, is removed.

In FIGS. 14–16, alphanumeric references P1 and P2 designate the directions in which the process cartridge B is installed into, or removed from, the apparatus main assembly, respectively. In this embodiment, the process cartridge B is installed into, or removed from, the apparatus main assembly in the direction perpendicular to the axial direction of the photosensitive drum 7 as shown in FIG. 4, with the developing means frame 40 side being placed to the front and the cleaning means frame 14 side being at the rear.

Referring to FIG. 12, the process cartridge B comprises a first projection 24, which is disposed at each of the longitudinal end surfaces of the cleaning means frame 14 to fix the position of the cartridge B, and a second projection 25, which maintains the orientation of the cartridge B. The first projection 24 is in line with the rotational axis of the photosensitive drum 7, and the second projection 25 is located behind the first projection 24 relative to the direction P1, in which the process cartridge B is installed into the apparatus A.

Further, the cleaning means frame 14 of this embodiment has a knob 26, which is integrally formed with the cleaning means frame 14. The knob 26 is disposed so as to be positioned above a line C—C, which connects the centers of the first and second projections 24 and 25.

On the other hand, the image forming apparatus A is provided with a cover 18, which is pivotally opened or closed about the axis 19. As the cover 18 is opened (FIG. 4), a space reserved in apparatus main assembly for accommodating the cartridge is exposed, wherein an installation guide member 20 as the cartridge installing means, such as the one shown in FIG. 13, is provided at each of the lateral sides of the space. This guide member 20 has a guide groove 20a, which extends in the diagonally downward direction to guide the first and second projections 24 and 25 of the process cartridge B, and at the bottom end of the guide groove 20a, a positioning recess 20b is provided.

Referring to FIG. 16, first, an operator grabs the knob 26 and engages the first projection 24, which is provided at each of the longitudinal end surfaces of the process cartridge B, into the groove 20a. Next, as the operator inserts the process cartridge B further into the image forming apparatus A along the groove 20a, the second projection 25 provided at each of the longitudinal end surfaces of the process cartridge B engages with the groove 20a. Then, the process cartridge B is further inserted along the groove 20a with the first and second projections 24 an 25 being engaged in the groove 20a. As the process cartridge B is inserted to the deepest point, the first projection 24 comes in contact with the wall 20b at the deepest end of the groove 20a as shown in FIG. 15. Then, the process cartridge B is slightly rotated by its moment in the clockwise direction (in the direction of an arrow a in FIG. 15) about the second projection 25. As a result, the first projection 24 drops into the recess 20b, fixing thereby the position of the process cartridge B, which concludes the installation of the process cartridge B. The orientation of the process cartridge in the apparatus A is maintained by the second projection, which is in engagement with the guide groove 20*a*. Further, the process cartridge B rotates only slightly to drop into the recess 20*b*; therefore, when a helical gear 7*a* provided at one of the longitudinal ends of the photosensitive drum 7 meshes with a helical gear 21 provided on the main assembly of the apparatus A, the gears are not likely to be damaged. Further, since the process cartridge B is rotated upward when it is removed from the main assembly of the apparatus A, the gears can be smoothly disengaged. The helical gear 21 transmits the driving force of a motor (unillustrated) provided on the apparatus main assembly to the photosensitive drum 7.

Next, steps for taking the process cartridge B out of the image forming apparatus in order to exchange the process cartridge B will be described.

When an attempt is made to simply pull the cartridge B out of the apparatus A, it is not going to be successful since the first projection 24 is in engagement with the recess 20*b*. Therefore, it is necessary to dissolve the engagement between the first projection 24 and positioning recess 20*b* before attempting to pull out the cartridge B. According to this embodiment, this state of engagement can be released in relation to the action for simply pulling out the cartridge B.

More specifically, as the operator pulls the knob 26 of the process cartridge B of this embodiment toward him/her in order to remove the process cartridge B, the process cartridge B is rotated counterclockwise (in the direction of an arrow b in FIG. 15) about the second projection 25, whereby the engagement between the projection 24 and recess 20*b* is simply broken. In other words, as the knob 26 is pulled in the arrow P2 direction as shown in FIG. 14, a force equivalent to an x-component Px of the force P2 is imparted on the first projection 24, generating thereby a rotational moment about the second projection 25, and at the same time, the first projection 24 is lifted by a y-component Pxy of the force Px, whereby the engagement between the projection 24 and positioning recess 20*b* is broken as shown in FIG. 15. In this state, the knob 26 is pulled in the arrow P2 direction, whereby the process cartridge B can be pulled out with the first and second projections 24 and 25 sliding along the guide groove 20*a*.

In other words, the operator can simply take the process cartridge B out of the image forming apparatus A just by pulling the knob 26 in the arrow P2 direction.

On the contrary, when the knob 26 is disposed below the line C—C connecting the centers of the first and second projections 24 and 25 as shown in FIG. 17, the process cartridge B does not rotate about the second projection 25 even if the operator pulls the knob 26 in the arrow P2 direction. Therefore, the engagement between the first projection 24 and positioning recess 20*b* is not broken. In such a case, the process cartridge B cannot be taken out unless the knob 26 is pushed down in the direction of an arrow Q to break the engagement between the projection 24 and recess 20*b*, and then, is pulled in the arrow P direction.

It is easily understandable from the above description that the structure of this embodiment, in which the knob 26 is disposed above the line C—C connecting the centers of the first and second projection 24 and 25, is advantageous since the process cartridge B can be simply taken out just by applying a force to the process cartridge B in the direction in which the cartridge B is taken out.

Further, forming integrally the first and second projections 24 and 25, and the knob 26 on the same member, that is, the cleaning means frame 14, can improve accuracy in the positional relationship among the components, eliminating thereby the loose fit associated with the first and second projection 24 and 25, and the knob 26.

{Other Embodiments}

Next, referring to FIGS. 18–20, the other embodiments of the present invention will be described regarding: (1) Frame structure of the developing means; (2) Shutter structure; and (3) Structure for installing or removing the cartridge, in this order, and then, (4) Structures of various other components will be described, wherein the components having the same functions as those of the first embodiment will be designated with the same reference symbols to eliminate the duplication of the description.

{Other Embodiments of Frame Structure of Developing Means}

In the first embodiment, when the frame member 12 and wall member 13 is joined, only the joint between the frame member 12 and toner chamber wall portion 13*a* is melt-welded, and the end member 21 is attached at each of the longitudinal end surfaces of both frame and wall members in order to fix the positional relationship between two components 12 and 13 (refer to FIG. 7). However, the frame member 12 and wall member 13 may be joined by melt-welding the entire length of the joint between the two members 12 and 13.

With such an arrangement, the two members 12 and 13 are more firmly joined, which can prevent the component displacement caused by torsional force. In this case, it is unnecessary to interpose the toner leak prevention seal 22 at the joint where the developing chamber wall portion 13*b* of the wall member 13 is joined with the frame member 12. Therefore, the component count can be reduced, which in turn reduces the assembly steps.

Further, in the first embodiment, the seal mounting portion 12*a* is provided on the frame member 12, and the sealing member 27 is mounted on this seal mounting portion 12*a* by gluing, melt-welding, or the like to seal the toner supplying opening 12*a*1. However, the sealing member 27 may be simply pinched as shown in FIG. 18.

Figure 18:
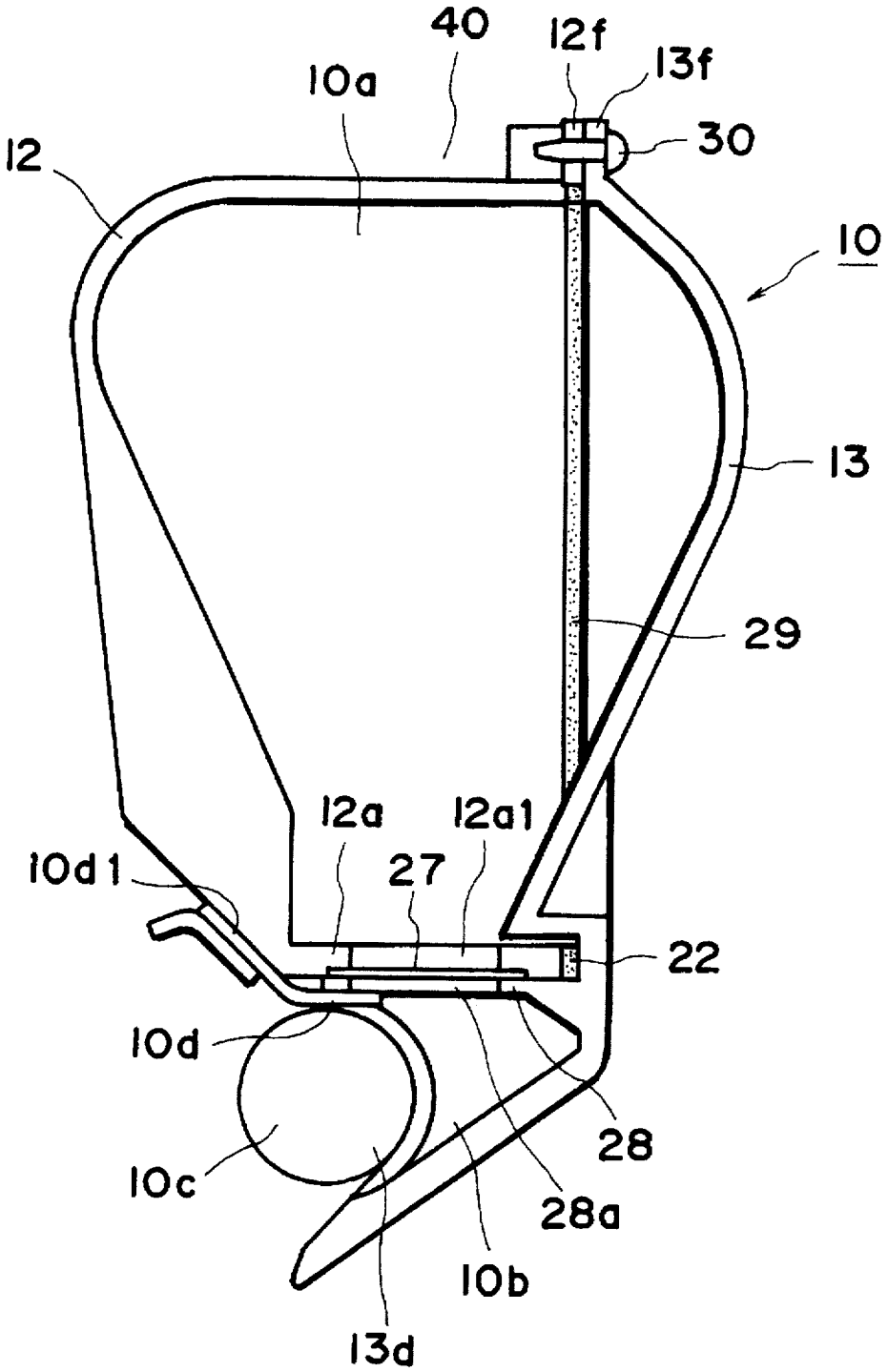
FIG. 18 is a sectional view of another embodiment of developing means, which comprises a seal retaining portion.

The frame member 12 illustrated in FIG. 18 comprises the seal mounting portion 12*a* with the toner supplying opening 12*a*1, which is similar to the arrangement in the first embodiment. However, in this embodiment, a seal retaining portion 28, which can join with the seal mounting portion 12*a* when the frame and wall members 12 and 13 are joined, is provided on the wall member 13, between the toner chamber wall 13*a* and developing chamber wall 13*b*. This seal retaining portion 28 is provided with a toner supplying opening 28*a*, the size and location of which coincides with those of the toner supplying opening 12*a*1.

The frame member 12 and wall member 13 are joined with a small screw 30 with the interposition of a toner leak prevention seal 29, which is composed of foamed polyurethane or the like, at the interface.

The sealing member 27 is retained at a predetermined location by being interposed between the seal mounting portion 12*a* and seal retaining portion 28 when the frame member 12 and wall member 13 are joined. Therefore, it is unnecessary to attach the sealing member 27 by gluing, melt-welding, or the like, which makes it easier to remove the sealing member 27 when the cartridge usage begins, and also, makes it easier to recycle the frame member 12 and wall member 13 since they are not contaminated with adhesive residue, welding residue, or the like.

Further, regarding the provision of the seal retaining portion 28 on the wall member 13, a hinge portion 31 may be provided at the border portion between the toner chamber wall portion 13*a* and developing chamber wall portion 13*b* to permit hinge motion.

Figure 19:
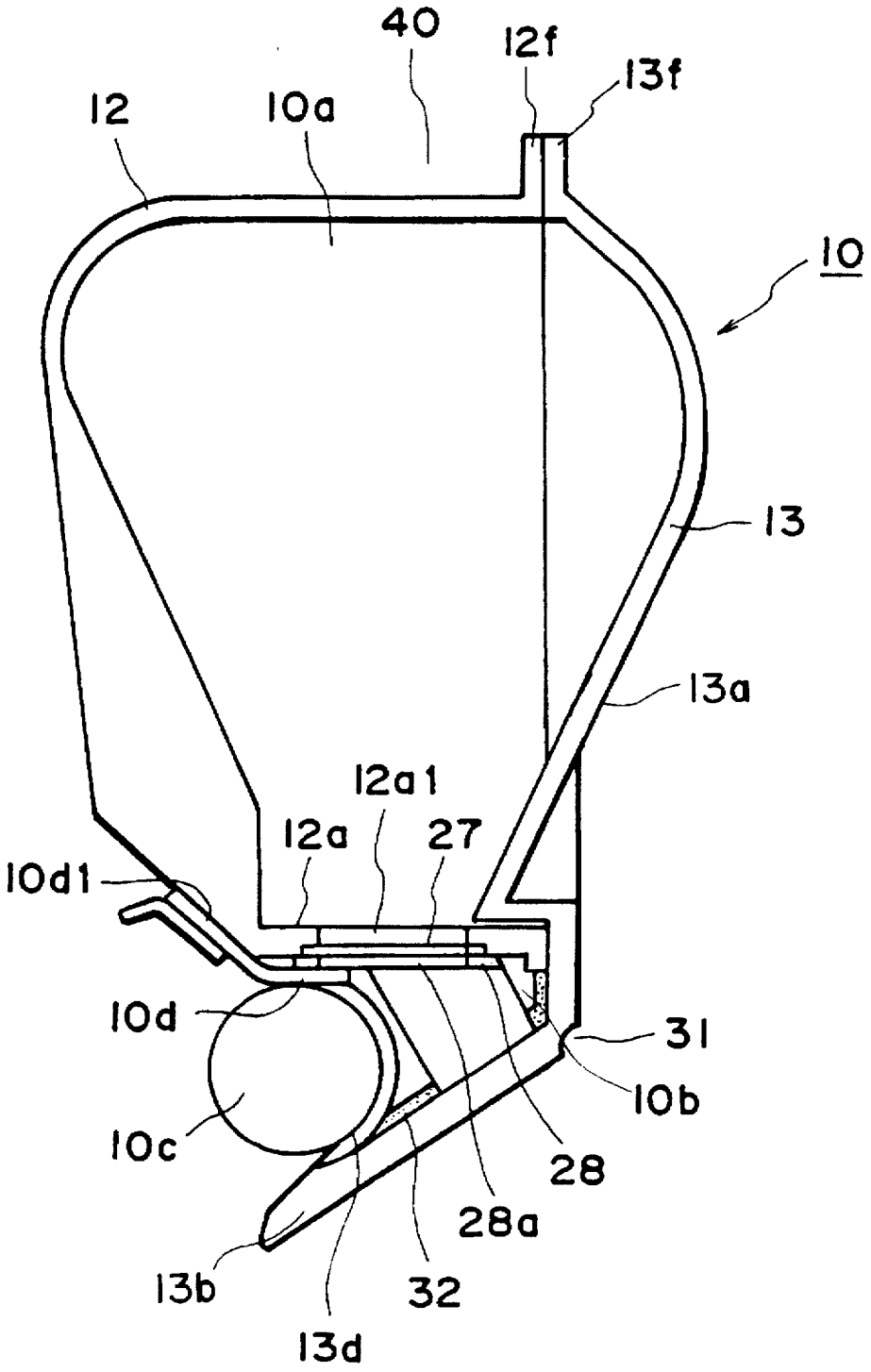
FIG. 19 is a sectional view of another embodiment of developing means, in which the wall member is provided with a hinge portion.

The structure illustrated in FIG. 19 is different from that illustrated in FIG. 18 in that there is a bendable hinge portion 31 between the toner chamber wall portion 13*a* and developing chamber wall portion 13*b* of the wall member 13, and that when the frame member 12 is joined with the wall member 13, the joint between the frame member 12 and toner chamber wall portion 13*a* is melt-welded, but a toner leak prevention seal 32 composed of foamed polyurethane or the like is interposed at the joint between the frame member 12 and developing chamber wall portion 13*b*.

In this case, the sealing member 27 can be simply pinched between the seal mounting portion 12*a* and seal retaining portion 28 just by bending the developing chamber wall portion 13*b* after melt-welding the joint between the frame member 12 and the toner chamber wall portion 13*a* of the wall member 13 during the assembly of the cartridge.

In the case of such a design as described above in which the wall member 13 is provided with the hinge portion 31, the position of the toner chamber wall portion 13*b* is fixed in a state of being bent at the hinge portion 31. Therefore, it is necessary to maintain the angle of the hinge portion 31 by attaching the end member 21 with the positioning bosses, at each of the longitudinal ends of the frame and wall members 12 and 13, after joining them in the same manner as the first embodiment.

Hereinbefore, the frame structure of the developing means was described with reference to the process cartridge including the one in the first embodiment, but such a structure is similarly applicable to developing apparatuses comprising a toner chamber, and a developing chamber in which a developing roller, a developing blade, and the like, are mounted, and the same effects can be expected.

{Other Embodiments of Shutter Structure}

In the case of the first embodiment described above, the shutter member 16 is made of a single piece comprising integrally the first shutter portion 16*a*, which exposes or covers the exposure opening 9, and the second shutter portion 16*b*, which exposes or covers the transfer opening 15 (refer to FIGS. 8 and 9). However, the first and second shutter portions 16*a* and 16*b* may be separate members as shown in FIG. 20.

Figure 20:
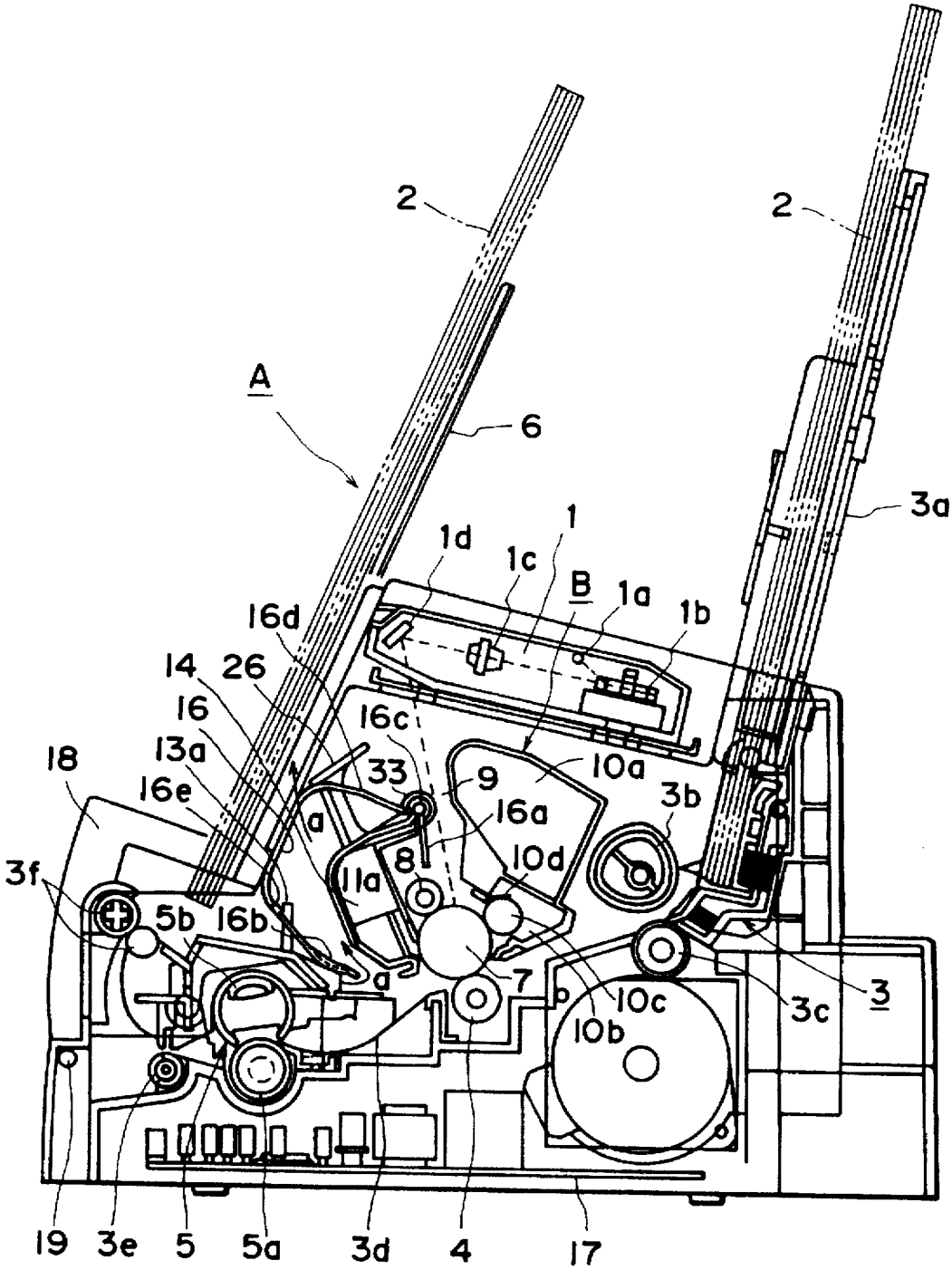
FIG. 20 is a sectional view of another embodiment of a shutter, in which the first and second shutter portions are interlocked with a link portion.

In the case of the shutter structure illustrated in FIG. 20, the first shutter portion 16*a*, which exposes or covers the exposure opening 9, and the second shutter portion 16*b*, which exposes or covers the transfer opening 15, are separate members, both of which are rotatively supported by the bearing portions provided on the top portion of the cleaning means frame 14, and are under a constant pressure, which is generated by an unillustrated spring in the closing direction.

As for the opening or closing means of the first shutter portion 16*a*, an arc-shaped link portion 33 is provided, which is integrally formed with the second shutter portion 16*b*. Therefore, as the second shutter portion 16*b* is opened, the link portion 33 moves together to push down the first shutter portion 16*a*, opening thereby the first shutter portion 16*a*. As the second shutter portion 16*b* is closed, the link portion 33 ceases holding down the first shutter portion 16*a*, allowing thereby the first shutter portion 16*a* to close.

Also, the above described structure makes it possible to interlock the opening or closing movement of the first shutter portion 16*a* with the opening or closing movement of the second shutter portion 16*b*. Therefore, the shutter portions can be reliably opened or closed without the provision of a complicated mechanism for opening or closing the shutter portions.

Even in the case of the structure illustrated in FIG. 20, the second shutter portion 16*b* is formed so that its arm portion 16*d* does not project beyond the longitudinal end portions of the cartridge frame, and the second shutter portion 16*b* forms the air passage for releasing the heat generated by the fixing means 5. Therefore, the same effects as the first embodiment can be expected.

{Other Embodiments of Structure for Installing or Removing Cartridge}

In the first embodiment, the removal of the process cartridge B from the image forming apparatus A is made easier by providing the cleaning means frame 14 with: the first and second projections 24 and 25, which are disposed on each of the longitudinal end surfaces; and the knob 26, which is disposed above the line connecting the projections 24 and 25, wherein, as the knob 26 is pulled, the cartridge B is rotated about the second projection, whereby the engagement between the first projection 24 and the recess portion 20*b* is broken (refer to FIG. 14).

However, when the process cartridge B is to be removed, the operator can break the engagement between the first projection 24 and recess portion 20*b* by holding the cartridge frame instead of the knob 26 and rotating the cartridge B about the second projection 25. After the engagement is broken, the cartridge B can be easily pulled out.

In other words, the process cartridge B can be taken out without the provision of the knob 26, just by rotating the process cartridge about the second projection 25.

Next, another embodiment of a process cartridge B will be described.

Figure 21:
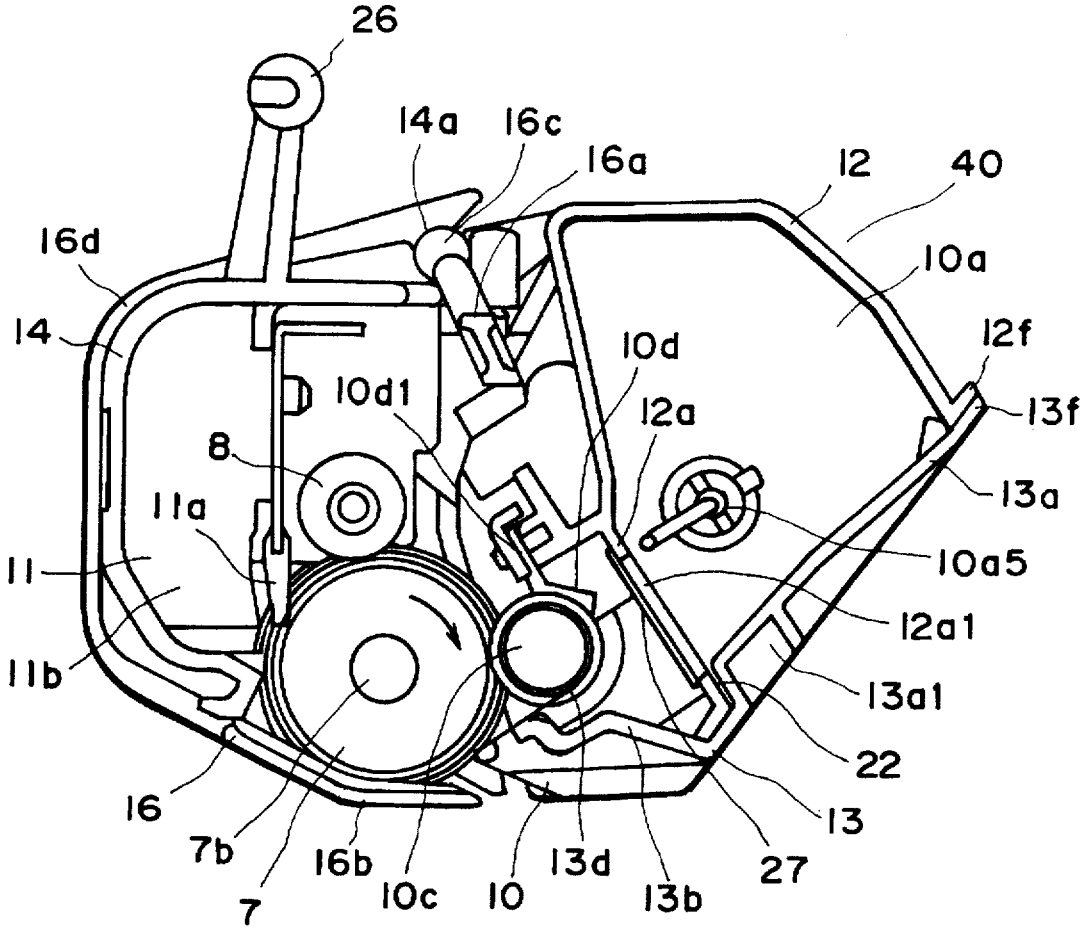
FIG. 21 is a sectional side view of another example of the process cartridge in accordance with the present invention.
Figure 22A:
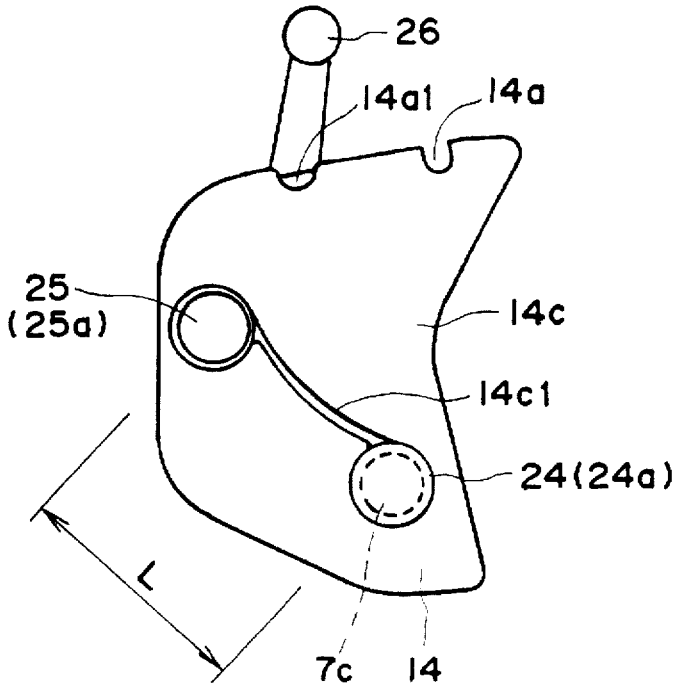
FIG. 22(*a*) is a left side view of the cleaning means frame of the process cartridge illustrated in FIG. 21, and FIG. 22(*b*) is a right side view of the cleaning means frame of the same.
Figure 22B:
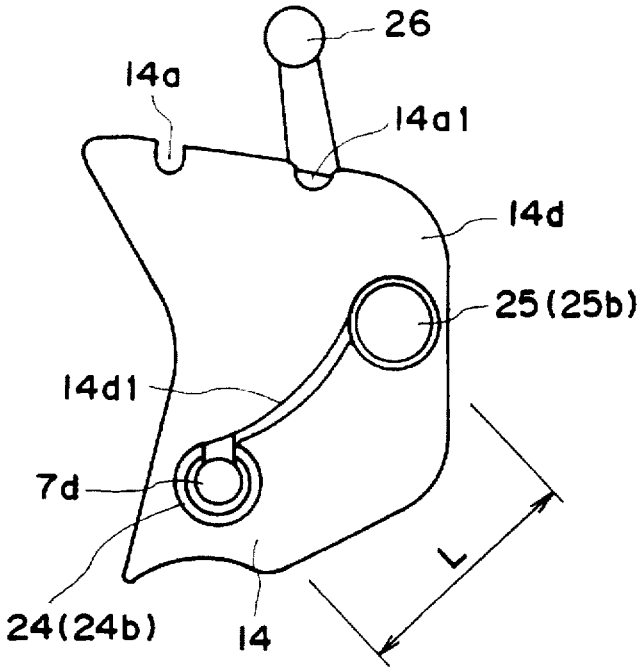
Figure 23A:
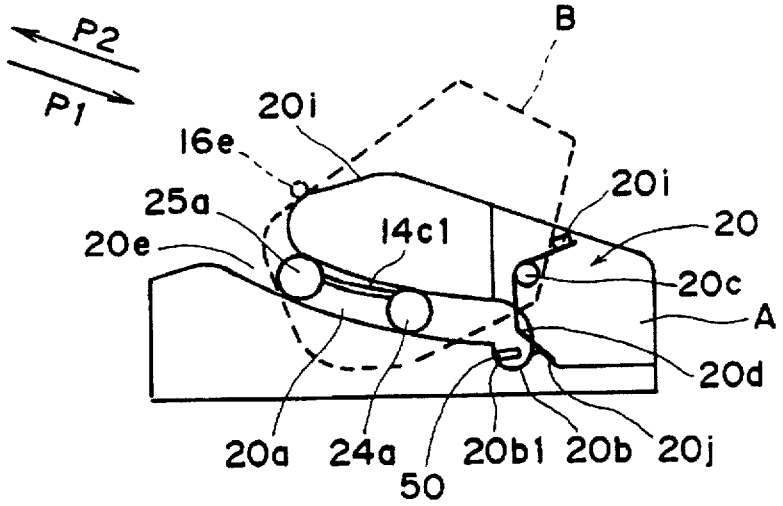
FIGS. 23(*a*), 23(*b*), and 23(*c*) are explanatory drawings, which depicts how the process cartridge illustrated in FIG. 21 is installed into, or removed from, the main assembly of the image forming apparatus.
Figure 23B:
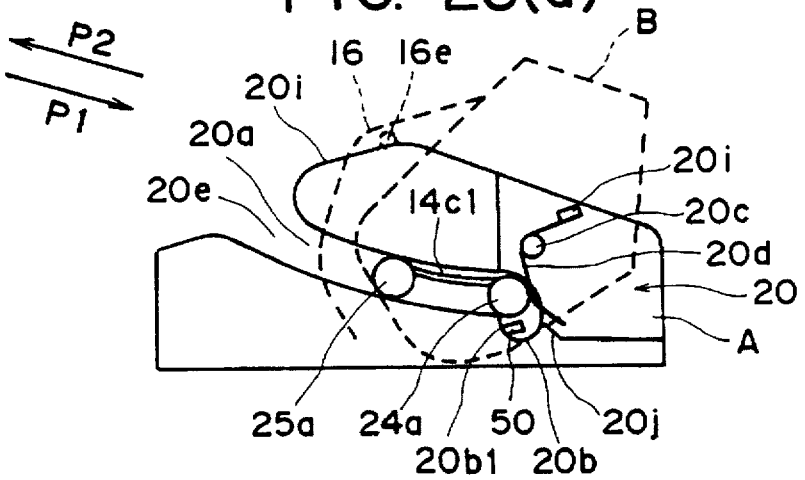
Figure 23C:
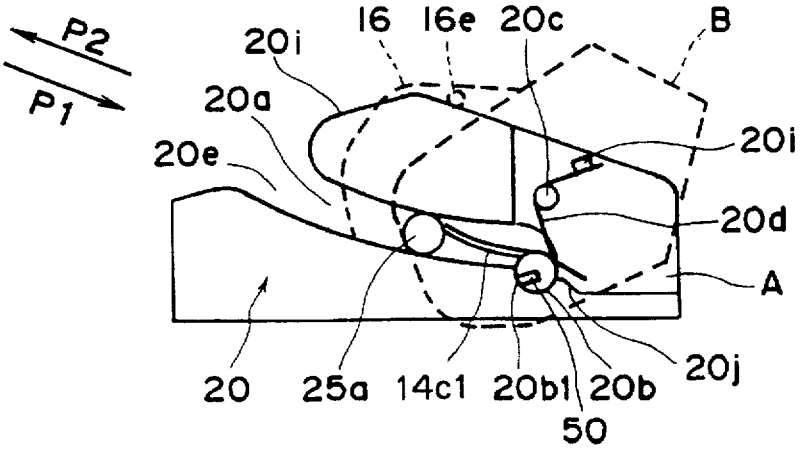
Figure 24:
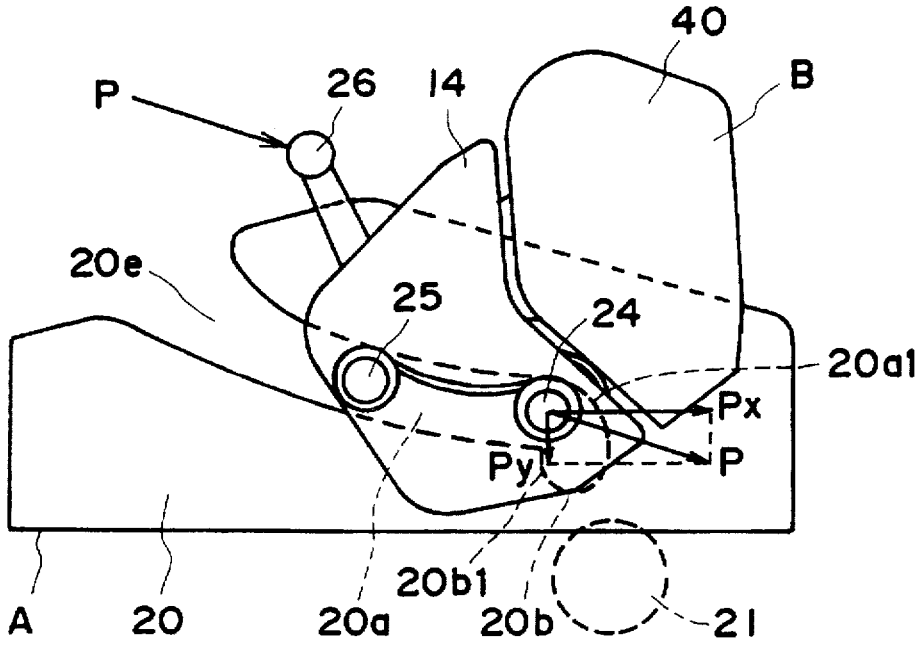
FIG. 24 is an explanatory drawing, which depicts the moment that works when the process cartridge illustrated in FIG. 21 is installed into the apparatus main assembly.
Figure 25:
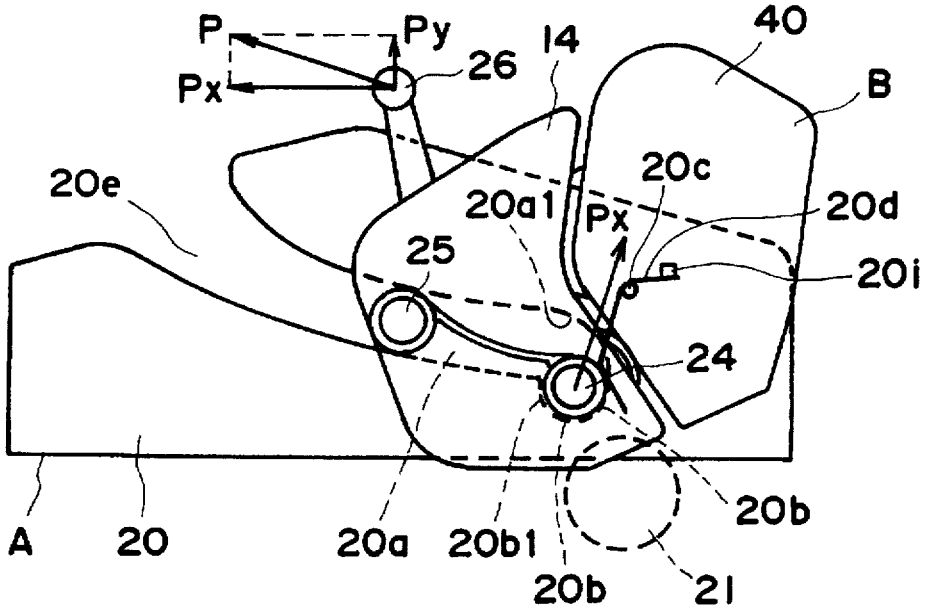
FIG. 25 is an explanatory drawing, which depicts the moment that works when the process cartridge illustrated in FIG. 21 is removed from the apparatus main assembly.

FIG. 21 is a cross-sectional view of another embodiment of the process cartridge B. FIG. 22(*a*) is a left side view of the cleaning means frame 14 of the process cartridge B; FIG. 22(*b*) is a right side view thereof. FIG. 23 is an explanatory drawing depicting how the process cartridge according to the present invention is inserted into, or removed from, an electrophotographic image forming apparatus. FIG. 24 is a side view of the process cartridge, describing the moment working during the cartridge insertion. FIG. 25 is a side view of the process cartridge, describing the moment working during the removal thereof. The members having the same functions as those in the first embodiment are designated with the same reference symbols to avoid confusion. It should be noted that a toner stirring means 10*a*5 is provided in the cartridge of this embodiment.

Referring to FIG. 22, the process cartridge employed in this embodiment comprises a left side frame portion 14*c* (first frame portion), which is located on the left end in the axial direction of the photosensitive drum 7 (FIG. 22(*a*)), and a right side frame portion 14*d* (second frame portion), which is located on the other end (FIG. 22(*b*)). The frame portion 14*c* is provided with a first projection 24*a* (first projection 24) and a second projection 25*a* (second projection 25), both of which project outward. The frame portion 14*d* is provided with a third projection 24*b* (first projection 24) and a fourth projection 25*b* (second projection 25), both of which also project outward. The first and third projections fix the position of the process cartridge B when the cartridge B is installed into the apparatus A main assembly, and the second and fourth projections serve as the rotational center of the process cartridge when the cartridge B is taken out of (installed into) the apparatus A main assembly. The first and third projection (first projection 24) are disposed in line with the axial line of the photosensitive drum 7; more specifically, they are cylindrical members formed in such a manner as to fit coaxially around the drum shaft of the photosensitive drum 7. Referring to FIG. 22(*a*), a metallic drum shaft 7*c* supporting the photosensitive drum 7 on the left side frame portion 14*c* projects beyond the first cylindrical projection 24*a*, and as the process cartridge B is inserted into the apparatus A main assembly, this drum shaft 7*c* comes in contact with an electrically conductive member (metallic plate spring 50 illustrated in FIGS. 23(*a*)–23(*c*)) to ground the photosensitive drum 7. Referring to FIG. 22(*b*), the alphanumeric reference 7*d* designates a metallic drum, which supports the photosensitive drum 7 on the right side frame portion 14*d*. Further, the left and right frame portions 14*c* and 14*d* are provided with a fifth projection 14*c* and a sixth projection 14*d*1, respectively, which also project outward. The fifth projection 14*c*1 bridges between the peripheral surfaces of the first and second cylindrical projections 24*a* and 25*a*, and the sixth projection 14*d*1 bridges the peripheral surfaces of the third and fourth cylindrical projections 24*b* and 25*b*. These fifth and sixth projections 14*c*1 and 14*d*1 prevent the cartridge B from being over-rotated when the operator takes his/her hand off the knob 26 by mistake immediately after he/she begins to insert the process cartridge B into the apparatus A main assembly, or immediately before he/she finishes removing the cartridge (state illustrated in FIG. 16). Further, when the process cartridge B is oriented, as shown in FIG. 21, with the photosensitive drum 7 positioned toward the bottom, the second cylindrical projection 25*a* is above the first cylindrical projection 24*a*; the fourth cylindrical projection 25*b* is above the third cylindrical projection 24*b*; the second cylindrical projection 25*a* is on the upstream side of the first cylindrical projection 24*a* relative to the direction in which the process cartridge B is inserted into the apparatus A main assembly. In the same manner, the fourth cylindrical projection 25*b* is disposed on the upstream side of the third cylindrical projection 24*b*. The first and third cylindrical projections 24*a* and 24*b* are the same in external diameter, whereas the external diameter of the second cylindrical projection 25*a* is larger than that of the first cylindrical projection 24*a* (also, the third cylindrical projection 24*b*), and the external diameter of the fourth cylindrical projection 25*b* is larger than that of the second cylindrical projection 25*a*. This arrangement of differentiating the sizes of the cylindrical projections can accomplish so-called three point support of the process cartridge B in the apparatus A main assembly (state illustrated in FIG. 14 and FIG. 23(*c*)), which improves the positioning accuracy of the process cartridge in the apparatus A main assembly. As for the actual measurements of these projections in this embodiment, the external diameters of the first and third cylindrical projections 24*a* and 24*b* are approximately 12 mm (tolerable range of 11.0 mm to 12.5 mm); the external diameter of the second cylindrical projection 24*b*, approximately 12.5 mm (tolerable range of 12.0 mm to 13.5 mm); and the fourth cylindrical projection 25*b* is approximately 13.0 mm (tolerable range of 12.0 mm to 13.5 mm). The heights of the first and second cylindrical projections 24*a* and 25*a* are approximately 4.5 mm (tolerable range of 1.0 mm to 5.5 mm), and the heights of the third and fourth cylindrical projection are approximately 4.0 mm (tolerable range of 1.0 mm to 5.0 mm). The height of the fifth projection 14*c* is approximately 3.0 mm (tolerable range of 0.0 mm to 5.5 mm), and the height of the sixth projection 14*d* is approximately 2.5 mm (tolerable range of 0.0 mm to 5.0 mm). It should be noted here that the provision of the fifth and sixth projections 14*c* and 14*d* is not mandatory. A distance L between the centers of the first and second cylindrical projections 24*a* and 25*a*, or between those of the third and fourth cylindrical projections 24*b* and 25*b*, is approximately 34 mm. The cleaning means frame 14 constructed integrally with the left side frame portion 14*c* (first frame portion) and right side frame portion 14*d* (second frame portion) contains the photosensitive drum 7, charging means (for example, charging roller 8), and cleaning means (for example, elastic cleaning blade 11*a*), whereas the developing means frame 40 (second cartridge frame) contains the developing means (for example, developing roller 10*c*) and toner storing portion (for example, toner chamber 12*b*). The cleaning means frame 14 and developing means frame 40 are joined pivotally from each other. The alphanumeric reference 14*a* designates a groove, with which the engagement projection 16*e* engages.

Referring to FIGS. 23(*a*)–23(*c*), steps for installing the process cartridge B into the main assembly of the apparatus A, or removing it therefrom, will be described.

In the same manner as the aforementioned embodiment, the first projection 24 (24*a* and 24*b*) and second projection 25 (25*a* and 25*b*) are fitted into the guide groove 20*a* and inserted farther into the apparatus along this groove 20*a*. As the cartridge B is inserted to the deepest point, the first projection 24 (24*a* and 24*b*) drops into the positioning recess 20*b*, fixing thereby the position of the cartridge B. At this time, the second projection 25 (25*a* and 25*b*) remains in the guide groove 20*a*, whereby the proper orientation of the cartridge B is maintained. Also, at this time, the position of the process cartridge B of this embodiment is fixed by the so-called three point support. Therefore, the position of the cartridge B in the apparatus A main assembly is more precisely fixed. Further, in this embodiment, the first projection 24 (24*a* and 24*b*), which is disposed in line with the axial line of the photosensitive drum 7, is dropped into the recess 20*b*, and this first projection 24 (24*a* and 24*b*) is retained in the recess 20*b* by direct pressure. More specifically, referring to FIGS. 23(*a*), 23(*b*), 23(*c*), a torsional coil spring 20*d* as a pressing means is mounted on a projection 20*c* provided on an installation/removal guide 20. One end of the spring 20*d* is anchored at a stopper 20*i* and the other is anchored at a stopper 20*j*, so that a portion of the torsional coil spring 20*d* projects into the space above the positioning recess 20*b*.

With such an arrangement being in place, as the process cartridge B is inserted along the guide groove 20*a* of the guide member 20 as illustrated in FIGS. 23(*a*), through 23(*c*, one end of the torsional coil spring 20*d* comes in contact with the stopper 20*j* as illustrated in FIG. 22(*a*), and as the cartridge B is farther inserted, the first projection 24 (24*a* and 24*b*) is caused to push the torsional coil spring 20*d* as illustrated in FIG. 22(*b*), whereby the one end of the spring 20*d* becomes separated from the stopper 20*j*, generating thereby such a force that presses down the first projection 24 (24*a* and 24*b*). Then, as the cartridge B is farther inserted, the first projection 24 (24*a* and 24*b*) drops into the positioning recess 20*b*, as shown in FIG. 23(*c*), concluding thereby the installation of the cartridge B. At this time, the first projection 24 (24*a* and 24*b*) is under the downward pressure from the spring 20*d*, being thereby pressed upon the abutting portion 20*b*1 of the positioning recess 20*b*. Therefore, the first projection 24 (24*a* and 24*b*) is securely held in the positioning recess 20*b*.

As described above, the first projection 24 (24*a* and 24*b*) disposed in line with the axial line of the photosensitive drum 7 is directly pressed down by the spring 20*d*; therefore, the positioning of the photosensitive drum 7 in the apparatus A main assembly becomes more accurate.

Next, referring to FIG. 24, the moment, which works to drop the first projection 24 (24*a* and 24*b*) into the recess 20*b*, will be described.

As an operator inserts the cartridge into the apparatus A through an opening 20*e* toward the positioning portion 20*b* (diagonally downward), holding the knob and using a force P, the first and second projections 24 (24*a* and 24*b*) and 25

(25*a* and 25*b*) are slid along the cartridge guide 20, wherein the first projection 24 is guided till it comes in contact with the deepest end 20*a*1 of the guide groove 20*a*, above the positioning portion 20*b*. At this point, the cartridge B begins to rotate about the second projection due to a y-component Py of the force P imparted on the first projection 24. As a result, the first projection 24 is engaged into the positioning portion 20*b*, ending the installation of the process cartridge B.

Next, referring to FIG. 25, the moment which works when the cartridge B is taken out, will be described. When the cartridge B is taken out of the apparatus main assembly, the steps illustrated in FIGS. 23(*c*), 23(*b*) and 23(*a*) are followed in this order.

As the operator pulls the knob 26 toward the opening 20*e* of the guide groove 20*a* (diagonally upward), using a force P, a rotational moment equivalent to the x-component Px of the force P is generated about the second projection 25 (25*a* and 25*b*), and is imparted on the first projection 24 (24*a* and 24*b*). As a result, the first projection 24 is lifted, whereby the engagement between the positioning portion 20*b* and first projection 24 is broken. In other words, the cartridge B is rotated counterclockwise about the second projection 25.

Then, as the operator pulls the knob 26 further toward him/her, the cartridge B comes out of the apparatus A main assembly with the first and second sliding along the guide groove 20*a*.

Further, in this embodiment, a shutter guide portion 20*i* is provided on the upper surface of the guide member 20, extending diagonally upward relative to the process cartridge B inserting direction. This shutter guide portion 20*i* is a portion with which a shutter projection 16*e* provided on the shutter arm 16*d* of the process cartridge B comes in contact. More specifically, as the process cartridge B is inserted along the guide groove 20*a*, the shutter projection 16*e* comes in contact with the guide portion 20*i*, and as the cartridge B is farther inserted, the shutter projection is pushed up. As a result, the shutter member 16 is rotated clockwise against the pressure of a spring (unillustrated) as shown in FIGS. 23(*a*) through 23(*c*), whereby the transfer opening 15 and exposure opening 9 are exposed. On the contrary, when the process cartridge B is taken out, the shutter projection 16*e* is pushed down by the pressure from the spring along the slanted surface of the guide portion 20*i*. As a result, the shutter member 16 is rotated counterclockwise, covering thereby the transfer opening 15 and exposure opening 9.

Further, in this embodiment, the first and second cylindrical projection 24*a* and 25*a* and the fifth projection 14*c*1 are integrally formed with the left side frame portion 14*c*, and the third and fourth cylindrical projections, 24*b* along with 25*b* and the sixth projection 14*d*1 are integrally formed with the right side frame portion. In other words, these cylindrical projections 24*a*, 24*b*, 25*a* and 25*b* and the projections 14*c*1 and 14*d*1 are integrally formed with the cleaning means frame 14. This cleaning means frame is composed of plastic material such as highly impact resistant styrene.

{Other Embodiments of Related Components}

The present invention is preferably applicable not only to the above described process cartridge B, which is used to form a monochrome image, but also to a multicolor process cartridge, which is used to form a multicolor image (image of two colors, three colors, or full-color) and comprises two or more developing means.

As for the developing method, the present invention is compatible with various well-known methods such as the double component magnetic brush developing method, cascade developing method, touch down developing method, cloud developing method, and the like.

As for the image bearing member to which the present invention is applicable, it is not limited to the aforementioned photosensitive drum. The present invention is also applicable to the following. To begin with, the photoconductive material is usable as the photosensitive material. As for the photoconductive material, amorphous silicon, amorphous selenium, zinc oxide, titanium oxide, organic photoconductor, or the like, is usable. Further, as for the configuration of a base member on which the photosensitive material is placed, it may be in the form of a rotary member such as a drum, or may be in the form of a sheet such as a belt or the like. Generally speaking, a base member in the form of a drum or a belt is used. For example, in the case of the base member of the drum type, the photoconductive material is coated, deposited, or placed by like means on a cylinder of aluminum alloy or the like.

Further, as to the structure of the charging means, the so-called contact charging method is employed in the first embodiment, but it is needless to say that the present invention is also applicable to other conventional charging methods such as the one in which a metallic shield of aluminum or the like is placed on three sides of a tungsten wire; a high voltage is applied to the tungsten wire to generate positive or negative ions; and the ions are transferred onto the surface of the photosensitive drum to charge it uniformly.

Further, the aforementioned charging means may be of the blade type, (charging blade), pad type, block type, rod type, wire type, or the like, in addition to the roller type described previously.

As for the method for cleaning the residual toner on the photosensitive drum, the cleaning means may be constructed of a blade, fur brush, magnetic brush, or the like.

The process cartridge described above is such a process cartridge that comprises an electrophotographic photosensitive member, or the like, and at least one processing means. In other words, the process cartridge to which the present invention is applicable may be of a different type other than the one employed in the above described embodiments. For example, it may be of such a type that a combination of: an image bearing member and a charging means; an image bearing member and a developing means; an image bearing member and a cleaning means; or an image bearing member and two or more of the aforementioned processing means is integrated into a replaceable form of cartridge for an image forming apparatus.

In other words, the process cartridge described above refers to a cartridge with a charging means, a developing means, or a cleaning means is integrated with an electrophotographic photosensitive member into a replaceable form of cartridge for an image forming apparatus; at least one of a charging means, a developing means, and a cleaning means is integrated with an electrophotographic member into the replaceable cartridge; or at least a developing means and an electrophotographic photosensitive member are integrated into the replaceable cartridge.

In the above described embodiments, a laser beam printer is described as an example of image forming apparatus, but the present invention is not limited to this example. That is, the present invention is also applicable to other image forming apparatuses such as electrophotographic copying machines, facsimile apparatuses, or word processors.

According to the present invention, the process cartridge is structured in such a manner that the movement of the first shutter portion, which exposes or covers the exposure opening, is interlocked with the movement of the second shutter portion, which exposes or covers the transfer opening. Therefore, it is unnecessary to provide separate mechanisms for opening or closing two shutter portions. As a result, the shutter portions can be simplified and made more reliable. Further, the aforementioned integration of the first and second shutter portions eliminates the need for a complicated link mechanism. Therefore, not only can the component count be reduced, but also, the assembly process can be simplified, which leads to a cost reduction.

Further, the rotational center of the shutter member is positioned on top of the cartridge frame. Therefore, the arm portion, which supports the second shutter portion which exposes or covers the transfer opening at each of the longitudinal ends, can be formed so that it does not project beyond the longitudinal end of the cartridge frame. As a result, the cartridge dimension in the longitudinal direction can be reduced, whereby the cartridge size can be reduced.

Further, when the process cartridge is installed into the image forming apparatus main assembly, the second shutter portion is opened in such a manner as to form an air passage. Therefore, the heat generated by the fixing means can be effectively released to prevent an internal temperature increase in the apparatus.

Further, the process cartridge is structured so as to comprise an electrophotographic photosensitive member, developing means, or the like. Therefore, a cartridge capable of recording a highly precise image can be provided.

Therefore, electrophotographic copying machines, laser beam printers, or the like, which employ the aforementioned process cartridge according to the present invention can more stably record a higher quality image.

Further, in this embodiment, the toner chamber and developing chamber are constructed by joining: the open frame member constituting the toner chamber frame portion and developing chamber frame portion, which are open on the same side; and the wall member constituting the toner chamber wall portion and developing chamber wall portion, which are joined with the corresponding open sides of the frame member. Therefore, it is possible to form the toner chamber and developing chamber of a complicated configuration by joining just two components. As a result, a developing apparatus or a process cartridge having a large toner capacity in spite of a smaller size can be constructed.

Further, the wall member is disposed at the edge of the toner supply opening, which is located between the toner chamber and developing chamber. Therefore, the toner is prevented from being unnecessarily left in the toner chamber, being thereby used without waste.

Further, the seal retaining portion, which retains the seal member for sealing the toner supply opening, is provided on the wall member; therefore, the sealing member can be easily mounted, and in addition, when a toner depleted developing apparatus or process cartridge is recovered for recycling, the frame member and wall member can be simply recycled.

Further, the wall member constructed of the toner chamber portion and developing chamber portion is bendable at the point between two portions. Therefore, a developing apparatus or process cartridge can be simply assembled.

Further, the end member is attached at each of the longitudinal ends of the frame member and wall member to fix the positional relation between the two members. Therefore, the frame member and wall member can be accurately joined.

Further, the cartridge is structured such that the toner chamber constituting a part of the developing means is disposed above the developing chamber. Therefore, the toner within the toner chamber is supplied to the developing chamber by its own weight, which eliminates the need for the provision of a toner delivering member.

Further, in the embodiments according to the present invention, the first projection is disposed in line with the axial line of the electrophotographic photosensitive member, and the second projection, which serves as the rotational center of the cartridge, is provided. Therefore, these projections serve not only as the guiding members when the process cartridge is inserted into, or removed from, the image forming apparatus, but also, the cartridge can be easily rotated about the second projection when the cartridge is taken out of the apparatus main assembly to disengage the first projection, which has dropped into the positioning recess of the apparatus main assembly. As a result, the cartridge can be smoothly pulled out of the apparatus.

Further, the second projection is positioned behind the first projection relative to the cartridge inserting direction, and the knob is disposed above the line extending from the line connecting the first and second projection. Therefore, the engagement between the first projection and positioning recess can be easily broken just by pulling the knob toward the operator, and then, the cartridge can be easily removed by pulling further the knob toward the operator.

Further, the cartridge installing means provided in the image forming apparatus is constructed so that the cartridge is to be inserted in the diagonally downward direction. Therefore the cartridge can be smoothly pulled out of the apparatus by holding the knob.

Further, the first and second projection, and the knob, are provided on the frame member which holds the electrophotographic photosensitive member. Thus, the cartridge can be easily rotated about the second projection.

Lastly, the process cartridge comprises: a frame member provided with the projections and a knob; an electrophotographic photosensitive member, a developing means, and the like, which are integrally contained in the frame member. Therefore, the electrophotographic copying machines, laser beam printers, or the like, can stably record a high quality image when constructed to be compatible with this process cartridge.

As described in the foregoing, according to the present invention, there is provided a process cartridge having a shutter of simple structure, and an image forming apparatus usable with the process cartridge.

While the invention has been described with reference to the structures disclosed herein, it is not confined to the details set forth and this application is intended to cover such modifications or changes as may come within the purposes of the improvements or the scope of the following claims.

What is claimed is:

1. A shutter for a process cartridge, said process cartridge including an electrophotographic photosensitive member, process means actable on said photosensitive member, a frame, an exposure opening for permitting exposure of said photosensitive member to image information light, an image transfer opening for permitting transfer of a toner image from said photosensitive member to a recording material, and said process cartridge being detachably mountable to a main assembly of an image forming apparatus, said shutter comprising:

an engaging portion for engaging said shutter with said frame;

a first shutter portion for opening and closing the exposure opening; and a second shutter portion for opening and closing the transfer opening, wherein said first shutter portion and said second shutter portion are interrelated.

2. A shutter according to claim 1, wherein said first shutter portion and said second shutter portion are integrally formed with a shaft that is at a center of rotation of said shutter when said shutter is mounted to said frame.

3. A shutter according to claim 2, wherein said second shutter portion is connected with said shaft through arms which have a configuration extending along an outer wall of the process cartridge when said shutter is mounted to said frame and when the exposure opening and the transfer opening are closed, and wherein said arms are at longitudinal opposite ends of said second shutter portion.

4. A shutter according to claim 3, wherein at least one of the arms has a projection at an end, said projection being contacted to an engaging portion of said main assembly to open said shutter when said process cartridge is mounted to said main assembly, wherein the projection is projected outwardly in a longitudinal direction of said photosensitive member, which is in the form of a drum.

5. A shutter according to claim 2 or 3, wherein said shaft functions as said engaging portion, and said shaft is resiliently and releasably engaged with a recess of said frame.

6. A shutter according to claim 1, 2, 3, or 4, wherein said shutter is cimprised of plastic resin material and is integrally formed.

7. A shutter according to claim 6, wherein said plastic resin material is high impact styrol material.

8. A shutter according to claim 1, 2, 3, or 4, wherein said first shutter portion and said second shutter portion are interrelatedly movable to open said exposure opening and said transfer opening when said engaging portion is mounted to said frame.

9. A shutter for a process cartridge, said process cartridge including an electrophotographic photosensitive member, process means actable on said photosensitive member, a frame, an exposure opening for permitting exposure of said photosensitive member to image information light, and an image transfer opening for permitting transfer of a toner image from said photosensitive member to a recording material, and said process cartridge being detachably mountable to a main assembly of an image forming apparatus, said shutter comprising:

a first shutter portion for opening and closing the exposure opening;

a second shutter portion for opening and closing the transfer opening;

a shaft for releasably mounting said shutter to said frame, said shaft functioning as a center of rotation of said shutter when said shutter is mounted to said frame; and an arm for connecting said second shutter portion and said shaft, wherein said first shutter portion, said second shutter portion, said shaft, and said arm are integrally formed of plastic resin material.

10. A shutter according to claim 9, wherein said second shutter portion is connected with said shaft through said arm which has a configuration extending along an outer wall of the process cartridge when said shutter is mounted to said frame and when the exposure opening and the transfer opening are closed, and wherein said arm is at each of longitudinal opposite ends of said second shutter portion.

11. A shutter according to claim 10, wherein at least one of the arms has a projection at an end, said projection being contacted to an engaging portion of said main assembly to open said shutter when said process cartridge is mounted to said main assembly, and wherein the projection is projected outwardly in a longitudinal direction of said photosensitive member, which is in the form of a drum.

12. A shutter according to claim 9, wherein said shaft functions as an engaging portion, and said shaft is resiliently and releasably engaged with a recess of said frame.

13. A shutter according to claim 9, wherein said plastic resin material is high impact styrol material.

14. A shutter according to claim 9, 10, 12 or 13, wherein said first shutter portion and said second shutter portion are interrelatedly movable to open said exposure opening and said transfer opening when said shaft is mounted to said frame.

15. A shutter according to claim 9, further comprising a plurality of said arm, wherein at least one of said arms has a projection at an end, said projection being contacted to an engaging portion of said main assembly to open said shutter when said process cartridge is mounted to said main assembly, and wherein the projection is projected outwardly in a longitudinal direction of said photosensitive member, which is in the form of a drum.

16. A shutter for a process cartridge, said process cartridge including an electrophotographic photosensitive member, process means actable on said photosensitive member, a frame, an exposure opening for permitting exposure of said photosensitive member to image information light, and an image transfer opening for permitting transfer of a toner image from said photosensitive member to a recording material, and said process cartridge being detachably mountable to a main assembly of an image forming apparatus, said shutter comprising:

a first shutter portion for opening and closing said exposure opening;

a second shutter portion for opening and closing said transfer opening;

a shaft provided at each longitudinal end of said second shutter portion for releasably mounting said shutter to said frame, said shafts functioning as a center of rotation of said shutter when said shutter is mounted to said frame; and an arm, provided at each longitudinal end of said second shutter portion, for connecting said second shutter portion and said shafts, wherein at least one of the arms has a projection at an end, said projection being contacted to an engaging portion of said main assembly to open said shutter when said process cartridge is mounted to said main assembly, and wherein the projection is projected outwardly in a longitudinal direction of said photosensitive member in the form of a drum, and wherein said first shutter portion, said second shutter portion, said shafts and said arms are integrally formed of plastic resin material.

17. A shutter according to claim 16, wherein said shafts function as an engaging portion, and said shafts are resiliently and releasably engaged with a recess of said frame.

18. A shutter according to claim 16 or 17, wherein said plastic resin material is comprised of high impact styrol material.

19. A shutter according to claim 17, wherein said first shutter portion and said second shutter portion are interrelatedly movable to open said exposure opening and said transfer opening when said shafts are mounted to said frame.

20. A process cartridge detachably mountable to an image forming apparatus, said process cartridge comprising:

an electrophotographic photosensitive member;

process means actable on said photosensitive member;

a frame;

an exposure opening for permitting exposure of said photosensitive member to image information light;

an image transfer opening for permitting transfer of a toner image from said photosensitive member to a recording material; and a shutter including:

a first shutter portion for opening and closing the exposure opening;

a second shutter portion for opening and closing the transfer opening; and an engaging portion for engaging said shutter with said frame, wherein said first shutter portion and said second shutter portion are interrelated.

21. A process cartridge according to claim 20, wherein said first shutter portion and said second shutter portion are integrally formed with a shaft that is at a center of rotation of said shutter when said shutter is mounted to said frame.

22. A process cartridge according to claim 20, wherein said second shutter portion is connected with a shaft through arms which have a configuration extending along an outer wall of the process cartridge when said shutter is mounted to said frame and when the exposure opening and the transfer opening are closed, wherein said arms are at longitudinal opposite ends of said second shutter portion.

23. A process cartridge according to claim 22, wherein at least one of the arms has a projection at an end, said projection being contacted to an engaging portion of a main assembly of said image forming apparatus to open said shutter when said process cartridge is mounted to said main assembly of said image forming apparatus, and wherein the projection is projected outwardly in a longitudinal direction of said photosensitive member, which is in the form of a drum.

24. A process cartridge according to claim 21 or 22, wherein said shaft functions as said engaging portion, and said shaft is resiliently and releasably engaged with a recess of said frame.

25. A process cartridge according to claim 20, 21, 22, or 23, wherein said shutter is comprised of plastic resin material and is integrally formed.

26. A process cartridge according to claim 25, wherein said plastic resin material is high impact styrol material.

27. A process cartridge according to claim 20, 21, 22, or 23, wherein said first shutter portion and said second shutter portion are interrelatedly moved to open said exposure opening and said transfer opening when said engaging portion is mounted to said frame.

28. A process cartridge detachably mountable to an image forming apparatus, said process cartridge comprising:

an electrophotographic photosensitive member;

process means actable on said photosensitive member;

a frame;

an exposure opening for permitting exposure of said photosensitive member to image information light;

an image transfer opening for permitting transfer of a toner image from said photosensitive member to a recording material; and a shutter including:

a first shutter portion for opening and closing said exposure opening; and a second shutter portion for opening and closing said transfer opening;

a shaft for releasably mounting said shutter to said frame, said shaft functioning as a center of rotation of said shutter when said shutter is mounted to said frame; and an arm for supporting said second shutter portion on said shafts, wherein said first shutter portion, said second shutter portion, said shaft, and said arm are integrally formed of plastic resin material.

29. A process cartridge according to claim 28, wherein said second shutter portion is connected with said shaft through said arm which has a configuration extending along an outer wall of the process cartridge when said shutter is mounted to said frame and when the exposure opening and the transfer opening are closed, wherein said arm is at each of longitudinal opposite ends of said second shutter portion.

30. A process cartridge according to claim 29, wherein at least one of the arms has a projection at an end, said projection being contacted to an engaging portion of a main assembly of said image forming apparatus to open said shutter when said process cartridge is mounted to said main assembly, and wherein the projection is projected outwardly in a longitudinal direction of said photosensitive member, which is in the form of a drum.

31. A process cartridge according to claim 29, further comprising a plurality of said arm, wherein at least one of said arms has a projection at an end, said projection being contacted to an engaging portion of a main assembly of said image forming apparatus to open said shutter when said process cartridge is mounted to said main assembly, and wherein the projection is projected outwardly in a longitudinal direction of said photosensitive member, which is in the form of a drum.

32. A process cartridge according to claim 28, wherein said shaft functions as an engaging portion, and said shaft is resiliently and releasably engaged with a recess of said frame.

33. A process cartridge according to claim 28, wherein said plastic resin material is high impact styrol material.

34. A process cartridge according to claim 28, wherein said first shutter portion and said second shutter portion are interrelatedly movable to open said exposure opening and said transfer opening when said shaft is mounted to said frame.

35. A process cartridge according to claim 20 or 28, wherein said process means contains charging means, developing means, or cleaning means.

36. A process cartridge according to claim 20 or 28, wherein said process means contains at least one of charging means, developing means, and cleaning means.

37. A process cartridge according to claim 20 or 28, wherein said process means contains at least developing means.

38. A process cartridge detachably mountable to an image forming apparatus, said process cartridge comprising:

an electrophotographic photosensitive drum;

a charging member for charging said photosensitive drum;

a developing member for developing a latent image formed on said photosensitive drum;

a frame;

an exposure opening for permitting exposure of said photosensitive drum to image information light;

a toner image transfer opening for permitting transfer of a toner image from said photosensitive drum to a recording material; and a shutter including:

a first shutter portion for opening and closing said exposure opening;

a second shutter portion for opening and closing said transfer opening;

a shaft, provided at each longitudinal end of said second shutter portion, for releasably mounting said shutter to said frame, said shafts functioning as a center of rotation of said shutter when said shutter is mounted to said frame; and an arm, provided at each longitudinal end of said second shutter portion, for supporting said second shutter portion on said shafts, wherein at least one of the arms has a projection at an end, said projection being contacted to an engaging portion of a main assembly of said image forming apparatus to open said shutter when said process cartridge is mounted to said main assembly, and wherein the projection is projected outwardly in a longitudinal direction of said photosensitive drum; and wherein said first shutter portion, said second shutter portion, said shafts, and said arms are integrally formed of plastic resin material.

39. A process cartridge according to claim 38, wherein said shafts function as an engaging portion, and said shafts are resiliently and releasably engaged with a recess of said frame.

40. A process cartridge according to claim 38 or 39, wherein said plastic resin material is high impact styrol material.

41. A process cartridge according to claim 38 or 39, wherein said first shutter portion and said second shutter portion are interrelatedly movable to open said exposure opening and said transfer opening when said engaging portion is mounted to said frame.

42. An image forming apparatus for forming an image on a recording material, said image forming apparatus comprising:

mounting means for removably mounting a process cartridge, said process cartridge being detachably mountable to said image forming apparatus, and said process cartridge including:

an electrophotographic photosensitive member;

process means actable on said photosensitive member;

a frame;

an exposure opening for permitting exposure of said photosensitive member to image information light;

an image transfer opening for permitting transfer of a toner image from said photosensitive member to a recording material; and a shutter including:

a first shutter portion for opening and closing said exposure opening;

a second shutter portion for opening and closing said transfer opening; and an engaging portion for engaging said shutter with said frame, wherein said first shutter portion and said second shutter portion are interrelated; and means for feeding the recording material.

43. An image forming apparatus for forming an image on a recording material, said image forming apparatus comprising:

mounting means for removably mounting a process cartridge, said process cartridge being detachably mountable to said image forming apparatus, and said process cartridge including:

an electrophotographic photosensitive member;

process means actable on said photosensitive member;

a frame;

an exposure opening for permitting exposure of said photosensitive member to image information light;

an image transfer opening for permitting transfer of an image from said photosensitive member to a recording material; and a shutter including:

a first shutter portion for opening and closing said exposure opening;

a second shutter portion for opening and closing said transfer opening;

a shaft for releasably mounting said shutter to said frame, said shaft functioning as a center of rotation of said shutter when said shutter is mounted to said frame; and an arm for supporting said second shutter portion and said shaft, wherein said first shutter portion, said second shutter portion, said shaft, and said arm are integrally formed of plastic resin material; and means for feeding the recording material.

44. An image forming apparatus for forming an image on a recording material, said image forming apparatus comprising:

mounting means for removably mounting a process cartridge, said process cartridge being detachably mountable to said image forming apparatus, and said process cartridge including:

an electrophotographic photosensitive member;

process means actable on said photosensitive member;

a frame;

an exposure opening for permitting exposure of said photosensitive member to image information light;

an image transfer opening for permitting transfer of an image from said photosensitive member to a recording material; and a shutter including:

a first shutter portion for opening and closing said exposure opening;

a second shutter portion for opening and closing said transfer opening;

a shaft, provided at each longitudinal end of said second shutter portion, for releasably mounting said shutter to said frame, said shafts functioning as a center of rotation of said shutter when said shutter is mounted to said frame;

an arm, provided at each longitudinal end of said second shutter portion, for connecting said second shutter portion and said shafts, wherein one of the arms has a projection at an end, said projection being contacted to an engaging portion of a main assembly of said image forming apparatus to open said shutter when said process cartridge is mounted to said main assembly, wherein the projection is projected outwardly in a longitudinal direction of said photosensitive member, which is in the form of a drum, and wherein said first shutter portion, said second shutter portion, said shafts, and said arms are integrally formed of plastic resin material; and means for feeding the recording material.

45. An apparatus according to claim 42, 43 or 44, wherein said image forming apparatus is an electrophotographic printer.

46. An apparatus according to claim 45, wherein said printer is a laser beam printer.

47. An apparatus according to claim 42, 43 or 44, wherein said image forming apparatus is an electrophotographic facsimile machine.

48. An apparatus according to claim 42, 43 or 44, wherein said image forming apparatus is an electrophotographic copying machine.

49. A shutter for a process cartridge, said process cartridge including an electrophotographic photosensitive member, a processing device actable on said photosensitive member, a frame, an exposure opening through which image information light exposes said photosensitive member, and an image transfer opening through which a toner image from said photosensitive member is transferred to a recording material, and said process cartridge being detachably mountable to a main assembly of an image forming apparatus, said shutter comprising:

a first shutter portion movably covering the exposure opening;

a second shutter portion movably covering the transfer opening;

a shaft, provided at each longitudinal end of said second shutter portion, for releasably mounting said shutter to said frame such that said shutter rotates about said shafts when said shutter is mounted to said frame;

an arm, provided at each longitudinal end of said second shutter portion, each of said arms connecting said second shutter portion and one of said shafts, wherein at least one of the arms has a projection at an end, said projection being contacted to an engaging portion of said main assembly to open said shutter when said process cartridge is mounted to said main assembly, and wherein the projection is projected outwardly in a longitudinal direction of said photosensitive member, which is in the form of a drum, wherein said first shutter portion, said second shutter portion, said shafts, and said arms are integrally formed of plastic resin material, wherein said shafts form a cartridge engaging portion, and said shafts are resiliently and releasably engaged with a recess of said frame, and wherein said first shutter portion and said second shutter portion are interrelatedly movable to open said exposure opening and said transfer opening when said engaging portion is mounted to said frame.

50. A process cartridge detachably mountable to an image forming apparatus, said process cartridge comprising:

an electrophotographic photosensitive drum;

a charging member for charging said photosensitive drum;

a developing member for developing a latent image formed on said photosensitive drum;

a frame;

an exposure opening through which image information light exposes said photosensitive drum;

an image transfer opening through which a toner image from said photosensitive drum is transferred to a recording material; and a shutter including:

a first shutter portion movably covering said exposure opening;

a second shutter portion movably covering said transfer opening;

a shaft, provided at each longitudinal end of said second shutter portion, for releasably mounting said shutter to said frame such that said shutter rotates about said shafts when said shutter is mounted to said frame;

an arm, at each longitudinal end of said second shutter portion, each of said arms connecting said second shutter portion and one of said shafts;

wherein at least one of the arms has a projection at an end, said projection being contacted to an engaging portion of a main assembly of said image forming apparatus to open said shutter when said process cartridge is mounted to said main assembly, and wherein the projection is projected outwardly in a longitudinal direction of said photosensitive drum, wherein said first shutter portion, said second shutter portion, said shafts, and said arms are integrally formed of plastic resin material, wherein said shafts form a cartridge engaging portion, and said shafts are resiliently and releasably engaged with a recess of said frame, and wherein said first shutter portion and said second shutter portion are interrelatedly movable to open said exposure opening and said transfer opening when said engaging portion is mounted to said frame.

* * * * *

UNITED STATES PATENT AND TRADEMARK OFFICE

CERTIFICATE OF CORRECTION

PATENT NO. : 5,729,796

DATED : March 17, 1998

INVENTOR(S) : KOUJI MIURA ET AL.

It is certified that error appears in the above-identified patent and that said Letters Patent is hereby corrected as shown below:

Title page, item

[54] TITLE

"HAVING THE SHUTTER" should be deleted.

[57] ABSTRACT

Line 7, "that" should be deleted.
Line 9, "one" should be --the--.

COLUMN 1

Line 4, "HAVING THE SHUTTER" should be deleted.

COLUMN 5

Line 26, "to" should be deleted.

COLUMN 6

Line 61, "station;" should read --station);--.

COLUMN 7

Line 16, "the this" should read --this--.

COLUMN 15

Line 55, "14c" should read --14c1--.
Line 57, "14d" should read --14d1--.
Line 59, "14c and 14d" should read --14c1 and 14d1--.

UNITED STATES PATENT AND TRADEMARK OFFICE

CERTIFICATE OF CORRECTION

PATENT NO. : 5,729,796

DATED : March 17, 1998

INVENTOR(S) : KOUJI MIURA ET AL.

It is certified that error appears in the above-identified patent and that said Letters Patent is hereby corrected as shown below:

COLUMN 16

Line 7, "14a" should read --14a1--.
Line 30, "23(c)," should read --and 23(c),--.
Line 39, ", through 23(c," should read --, through 23(c),--.

COLUMN 21

Line 25, "cimprised" should read --comprised--.

Signed and Sealed this

Sixteenth Day of November, 1999

*Attest:*

Q. TODD DICKINSON

*Attesting Officer*

*Acting Commissioner of Patents and Trademarks*